US007796146B2

(12) United States Patent
Kawada et al.

(10) Patent No.: US 7,796,146 B2
(45) Date of Patent: Sep. 14, 2010

(54) IMAGE FORMING APPARATUS, AN IMAGE FORMING METHOD AND AN IMAGE DETECTING METHOD

(75) Inventors: Kunihiro Kawada, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 67 days.

(21) Appl. No.: 12/197,836

(22) Filed: Aug. 25, 2008

(65) Prior Publication Data

US 2009/0060580 A1 Mar. 5, 2009

(30) Foreign Application Priority Data

Aug. 27, 2007 (JP) ..... 2007-219768
Jul. 2, 2008 (JP) ..... 2008-173197

(51) Int. Cl.
*G03G 15/00* (2006.01)

(52) U.S. Cl. ..... 347/116

(58) Field of Classification Search ..... 347/116; 399/49

See application file for complete search history.

(56) References Cited

U.S. PATENT DOCUMENTS

2009/0060542 A1* 3/2009 Kawada et al. ..... 399/47

FOREIGN PATENT DOCUMENTS

JP 2642351 8/1997
JP 2002-132007 5/2002

* cited by examiner

*Primary Examiner*—Huan H Tran
(74) *Attorney, Agent, or Firm*—Hogan Lovells US LLP

(57) ABSTRACT

An image forming apparatus, includes: an exposure head that includes a plurality of imaging optical systems which are arranged in a first direction and a plurality of light emitting elements which emit lights to be imaged by the imaging optical systems; a latent image carrier that moves in a second direction orthogonal to or substantially orthogonal to the first direction and carries a latent image formed by the exposure head; a developer that develops the latent image; and a detector that detects an image developed by the developer, wherein the image detected by the detector has a width in the first direction wider than that of an image formed by one imaging optical system.

15 Claims, 37 Drawing Sheets

Dsm>Wlm $Dsm > (N-1) \times Wlm$

IMAGE FORMING APPARATUS, AN IMAGE FORMING METHOD AND AN IMAGE DETECTING METHOD

CROSS REFERENCE TO RELATED APPLICATION

The disclosure of Japanese Patent Applications No. 2007-219768 filed on Aug. 27, 2007 and No. 2008-173197 filed on Jul. 2, 2008 including specification, drawings and claims is incorporated herein by reference in its entirety.

BACKGROUND

1. Technical Field

The invention relates to techniques for stabilizing a result of detecting an image.

2. Related Art

There has been conventionally known an image forming apparatus for forming a test image (detection image or image-to-be-detected) and detecting this test image to obtain information relating to image formation. For example, an image forming apparatus disclosed in Japanese Patent No. 2642351 forms test images ("detection pattern" of Japanese Patent No. 2642351) for a plurality of colors and obtains color misregistration information necessary for color image formation. Specifically, the apparatus disclosed in Japanese Patent No. 2642351 forms a color image by superimposing toner images of a plurality of colors on a transfer medium. In order to satisfactorily form this color image, test images are formed for the respective colors. The test images are detected by optical sensors and the positions of the test images are obtained from the detection results. The color misregistration information can be obtained from the thus obtained positions of the test images of the respective colors. In this way, the test images are formed and the information relating to image formation is obtained from the detection results on the test images in the apparatus disclosed in Japanese Patent No. 2642351.

SUMMARY

In order to realize the formation of an image with high resolution, the surface of a latent image carrier can be exposed by the following line head. This line head includes a plurality light emitting elements grouped into light emitting element groups. The respective light emitting element groups emit light beams toward the surface of the latent image carrier moving in a sub scanning direction and can expose regions mutually different in a main scanning direction orthogonal to the sub scanning direction. In the case of forming a test image, the light emitting element groups expose the surface of the latent image carrier to form a test latent image and the test latent image is developed to form the test image. However, due to a variation of a moving speed of the surface of the latent image carrier, the position of a latent image formed by the different light emitting element groups may vary in the sub scanning direction in some cases. A similar variation is seen even in the test image obtained by developing the test image having such a variation. As a result, there have been cases where the detection result on the test image becomes unstable.

An advantage of some aspects of the invention is to stably detect an image even if the above variation occurs in the image.

According to a first aspect of the invention, there is provided an image forming apparatus, comprising: an exposure head that includes a plurality of imaging optical systems which are arranged in a first direction and a plurality of light emitting elements which emit lights to be imaged by the imaging optical systems; a latent image carrier that moves in a second direction orthogonal to or substantially orthogonal to the first direction and carries a latent image formed by the exposure head; a developer that develops the latent image; and a detector that detects an image developed by the developer, wherein the image detected by the detector has a width in the first direction wider than that of an image formed by one imaging optical system.

According to a second aspect of the invention, there is provided an image detecting method, comprising: forming an image by developing a latent image that is formed on a latent image carrier moving in a second direction orthogonal to or substantially orthogonal to a first direction by means of an exposure head which includes a plurality of imaging optical systems arranged in the first direction and a plurality of light emitting elements arranged corresponding to the imaging optical systems, the imaging optical systems imaging lights from the plurality of light emitting elements on the latent image carrier to form the latent image; and detecting the image formed at the forming, the image having a width in the first direction wider than that of an image formed by one imaging optical system.

According to a third aspect of the invention, there is provided an image forming method, comprising: forming an image by developing a latent image that is formed on a latent image carrier moving in a second direction orthogonal to or substantially orthogonal to a first direction by means of an exposure head which includes a plurality of imaging optical systems arranged in the first direction and a plurality of light emitting elements arranged corresponding to the imaging optical systems, the imaging optical systems imaging lights from the plurality of light emitting elements on the latent image carrier to form the latent image; and detecting the image formed at the forming, the image having a width in the first direction wider than that of an image formed by one imaging optical system.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

I. Basic Construction of an Image Forming Apparatus

Figure 1:
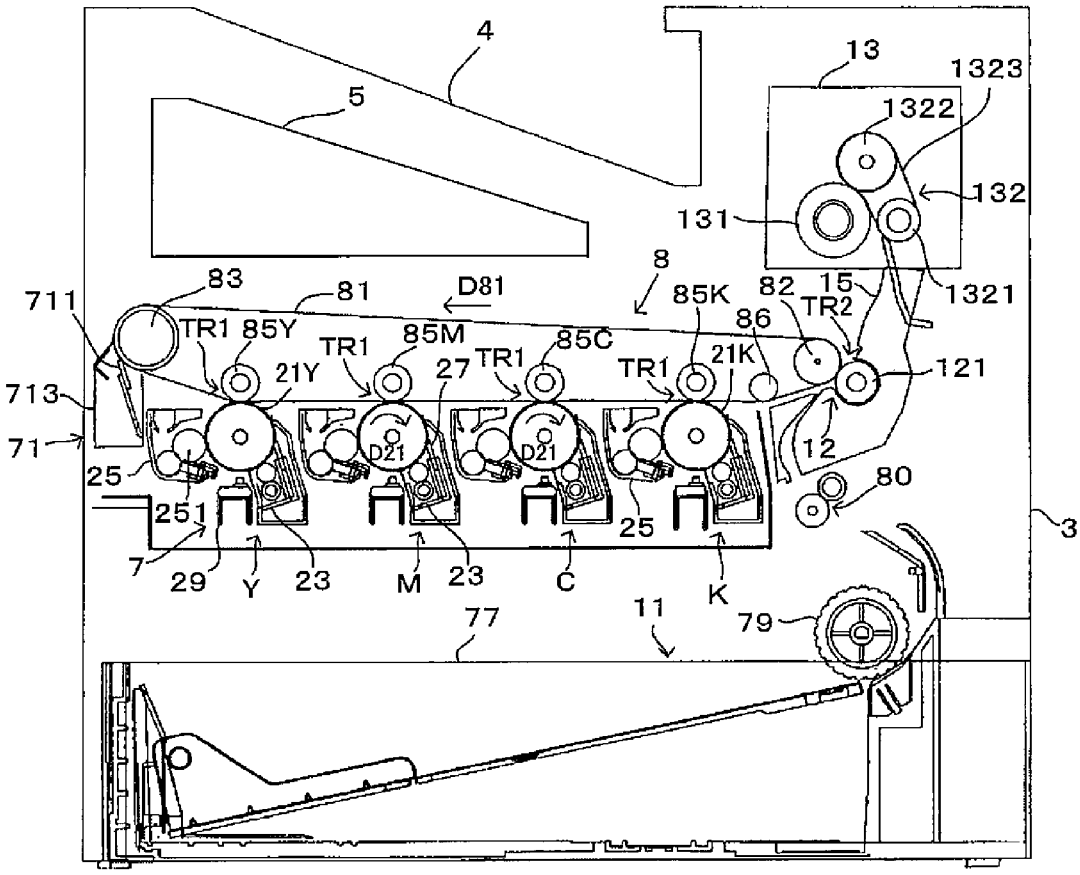
FIG. 1 is a diagram showing an embodiment of an image forming apparatus to which the invention is applicable.
Figure 2:
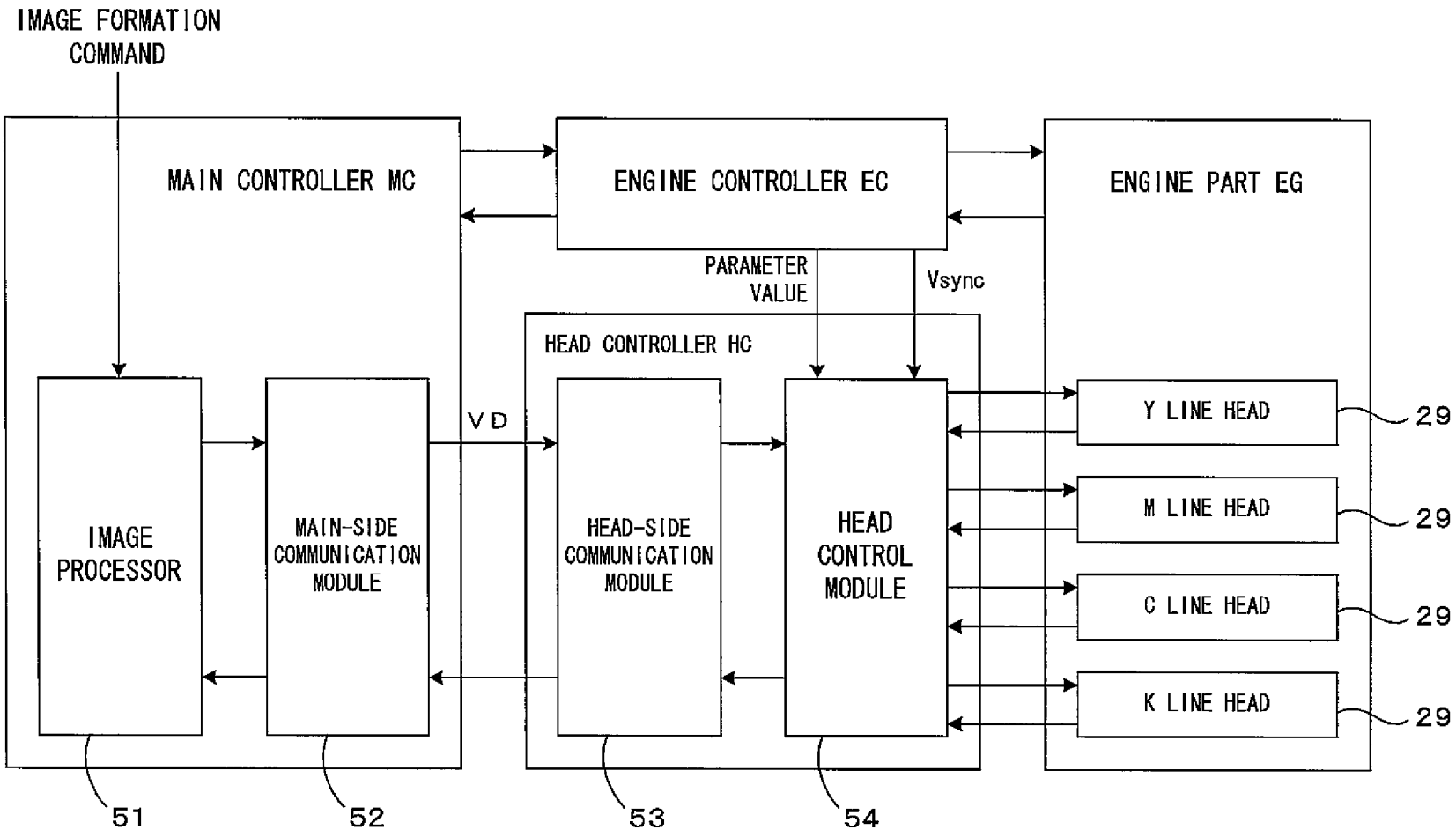
FIG. 2 is a diagram showing the electrical construction of the image forming apparatus of FIG. 1.

FIG. 1 is a diagram showing an embodiment of an image forming apparatus to which the invention is applicable. FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y. M, C and K includes a cylindrical photosensitive drum 21 having a surface of a specified length in a main scanning direction MD. Each of the image forming stations Y. M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 1, whereby the surface of the photosensitive drum 21 is transported in a sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections.

Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1*i*

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head includes a plurality of light emitting elements arrayed in the longitudinal direction and is positioned separated from the photosensitive drum 21. Light beams are emitted from these light emitting elements to irradiate (in other words, expose) the surface of the photosensitive drum 21 charged by the charger 23, thereby forming a latent image on this surface. The head controller HC is provided to control the line heads 29 of the respective colors, and controls the respective line heads 29 based on the video data VD from the main controller MC and a signal from the engine controller EC. Specifically, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller TIC generates signals for controlling the driving of the elements of the line heads 29 of the respective colors and outputs them to the respective line heads 29. In this way, the operations of the light emitting elements in the respective line heads 29 are suitably controlled to form latent images corresponding to the image formation command.

The photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position tri to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position tri and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

II. Construction of Line Head

Figure 3:
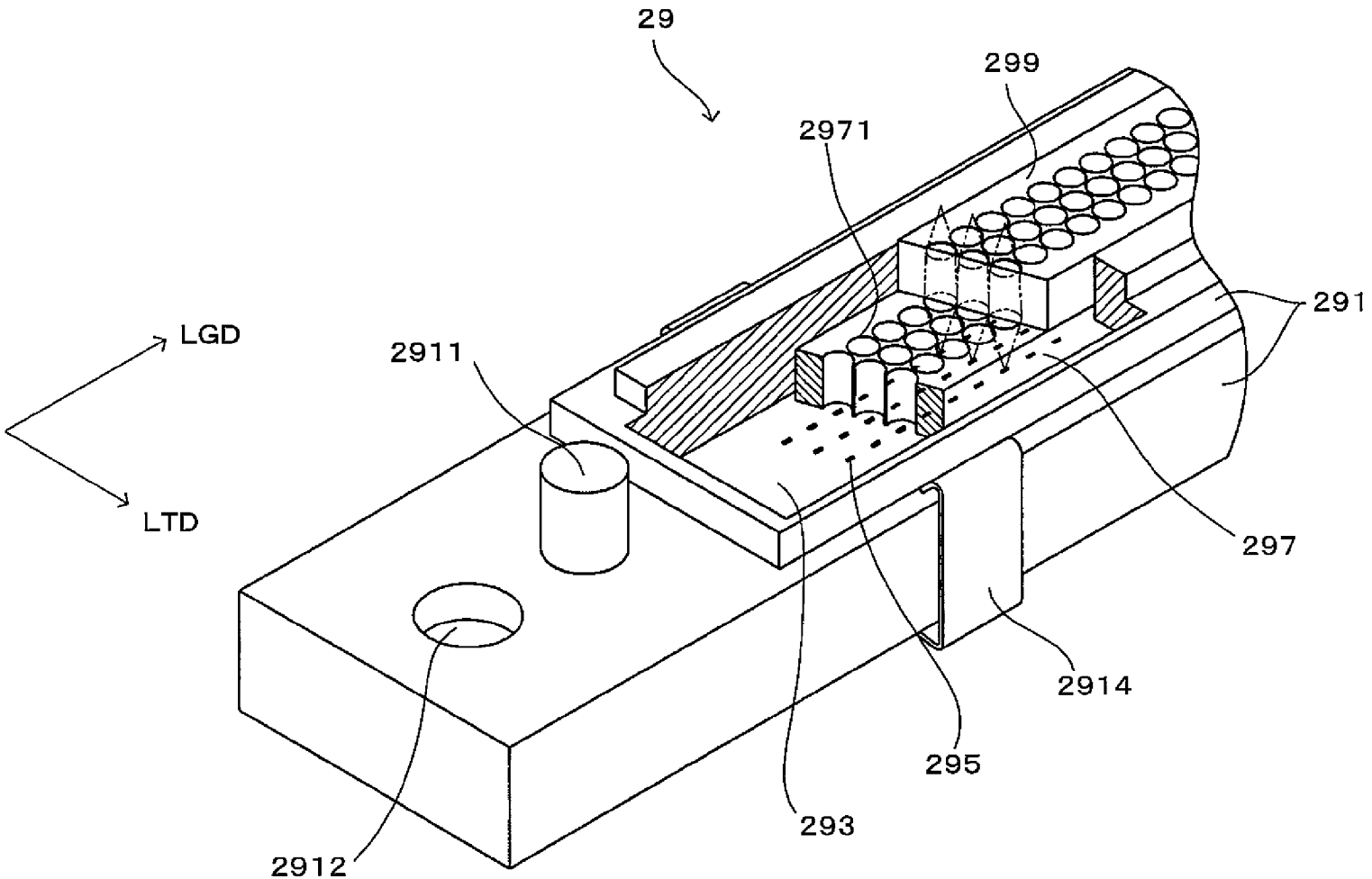
FIG. 3 is a perspective view schematically showing a line head.
Figure 4:
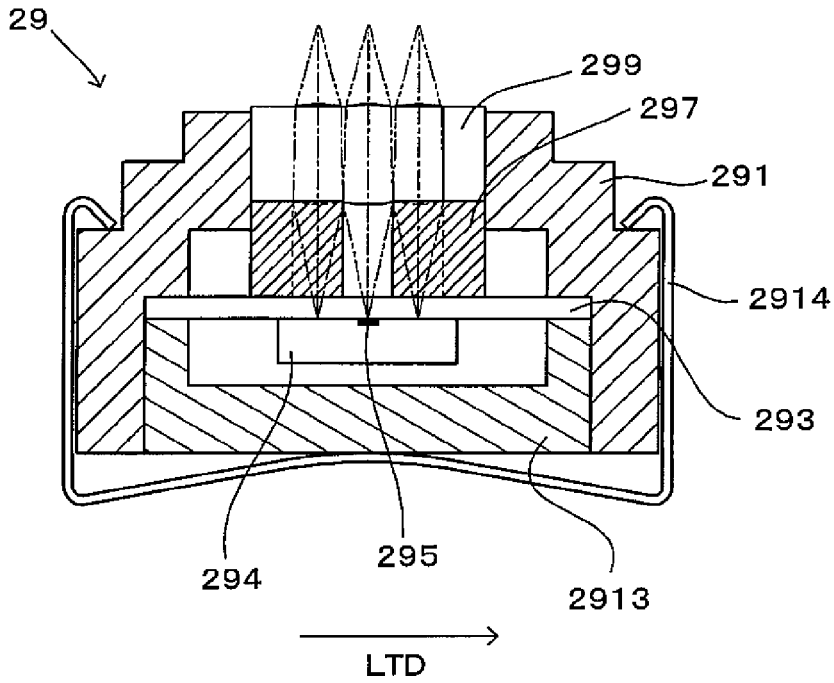
FIG. 4 is a sectional view along a width direction of the line head shown in FIG. 3.

FIG. 3 is a perspective view schematically showing a line head, and FIG. 4 is a sectional view along a width direction of the line head shown in FIG. 3. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are normal to or substantially normal to each other. Hence, the longitudinal direction LGD is parallel to or substantially parallel to the main scanning direction MD while the width direction LTD is parallel to or substantially parallel to the sub scanning direction SD. The line head 29 of this embodiment includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of light emitting element groups 295 are provided on an under surface of the head substrate 293 (surface opposite to the lens array 299 out of two surfaces of the head substrate 293). Specifically, the plurality of light emitting element groups 295 are two-dimensionally arranged on the under surface of the head substrate 293 while being spaced by specified distances in the longitudinal direction LGD and the width direction LTD. Here, each light emitting element group 295 is formed by two-dimensionally arraying a plurality of light emitting elements. This will be described in detail later. Bottom emission-type EL (electroluminescence) devices are used as the light emitting elements. In other words, the organic EL devices are arranged as light emitting elements on the under surface of the head substrate 293. Thus, all the light emitting elements 2951 are arranged on the same plane (under surface of the head substrate 293). When the respective light emitting elements are driven by a drive circuit formed on the head substrate 293, light beams are emitted from the light emitting elements in directions toward the photosensitive drum 21. These light beams propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normals to the head substrate 293.

Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As described above, in this embodiment, some lights out of lights being emitted from the light emitting elements 2951 pass through the light guide holes 2971 formed in the light shielding member 297. The some lights are incident on the lenses LS and contribute to image formation. In other words, the lights incident on the lenses LS and contributing to image formation are restricted by the light shielding member 297. Accordingly, a problem of disturbing the formed image by stray lights and the like is suppressed by the light shielding member 297, and a detection image such as a registration mark RM to be described later can be satisfactorily formed. By detecting a detection image satisfactorily formed in this way, the detection result on the detection image can be made stable.

As shown in FIG. 4, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 5:
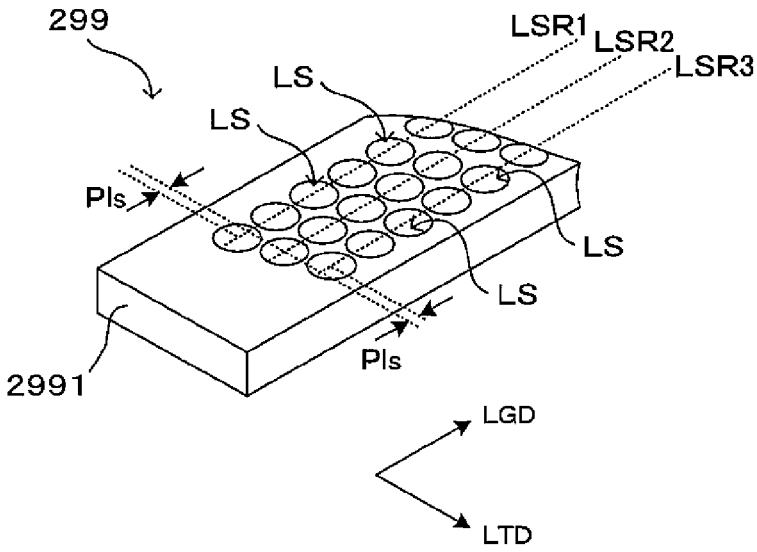
FIG. 5 is a schematic partial perspective view of the lens array.
Figure 6:
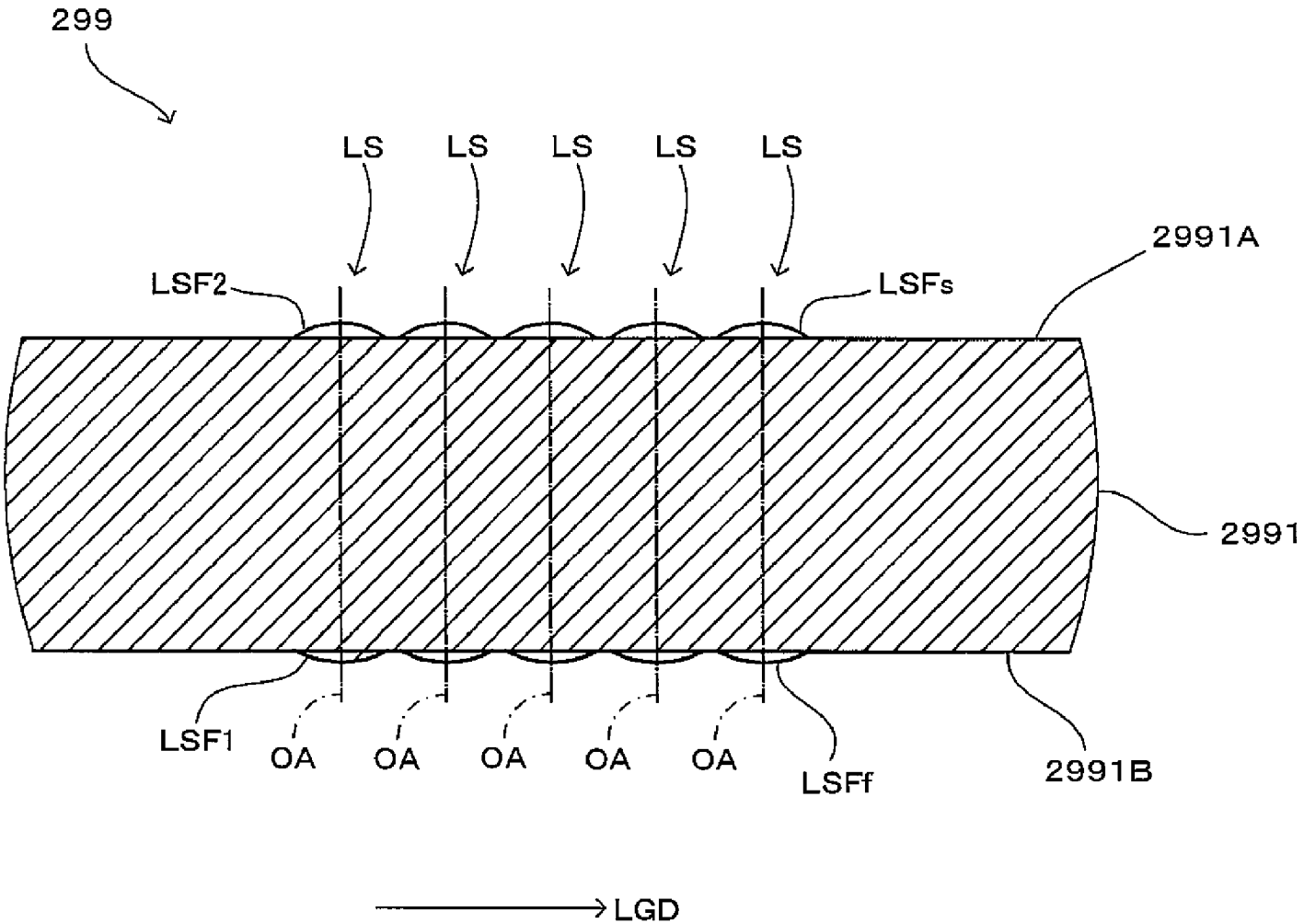
FIG. 6 is a sectional view of the lens array in the longitudinal direction.

FIG. 5 is a schematic partial perspective view of the lens array, and FIG. 6 is a sectional view of the lens array in the longitudinal direction LGD. The lens array 299 includes a lens substrate 2991. First surfaces LSFf of lenses LS are formed on an under surface 2991B of the lens substrate 2991, and second surfaces LSFs of the lenses LS are formed on a top surface 2991A of the lens substrate 2991. The first and second surfaces LSFf; LSFs facing each other and the lens substrate 2991 held between these two surfaces function as one lens LS. The first and second surfaces LSFf, LSFs of the lenses LS can be made of resin for instance.

The lens array 299 is arranged such that optical axes OA of the plurality of lenses LS are substantially parallel to each other. The lens array 299 is also arranged such that the optical axes OA of the lenses LS are substantially normal to the under surface (surface where the light emitting elements 2951 are arranged) of the head substrate 293. At this time, these plurality of lenses LS ate arranged in a one-to-one correspondence with the plurality of light emitting element groups 295 to be described later. In other words, the plurality of lenses LS are two-dimensionally arranged at specified intervals in the longitudinal direction LGD and the width direction LTD in correspondence with the arrangement of the light emitting element groups 295 to be described later, and focus the lights from the corresponding light emitting element groups 295 to expose the surface of the photosensitive drum 21. These respective lenses LS are arranged as follows. Specifically, a plurality of lens rows LSR, in each of which a plurality of lenses LS are aligned in the longitudinal direction LGD, are arranged in the width direction LTD. In this embodiment, three lens rows LSR1, LSR2, LSR3 are arranged in the width direction LTD. The three lens rows LSR1 to LSR3 are arranged at specified lens pitches Pls in the longitudinal direction, so that the positions of the respective lenses LS differ in the longitudinal direction LGD. In this way, the respective lenses LS can expose regions mutually different in the main scanning direction MD.

Figure 7:
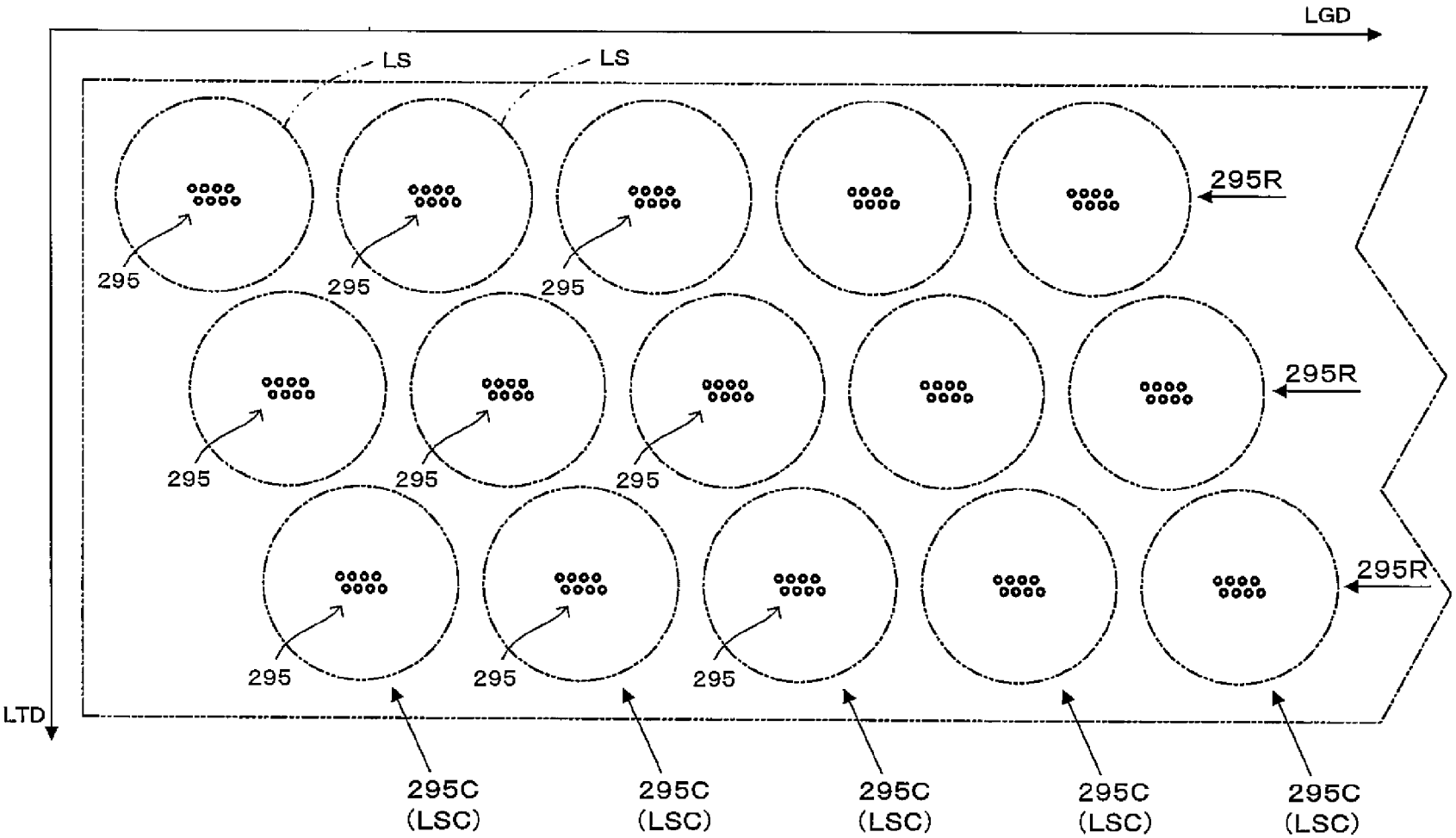
FIG. 7 is a diagram showing the arrangement of the light emitting element groups in the line head.
Figure 8:
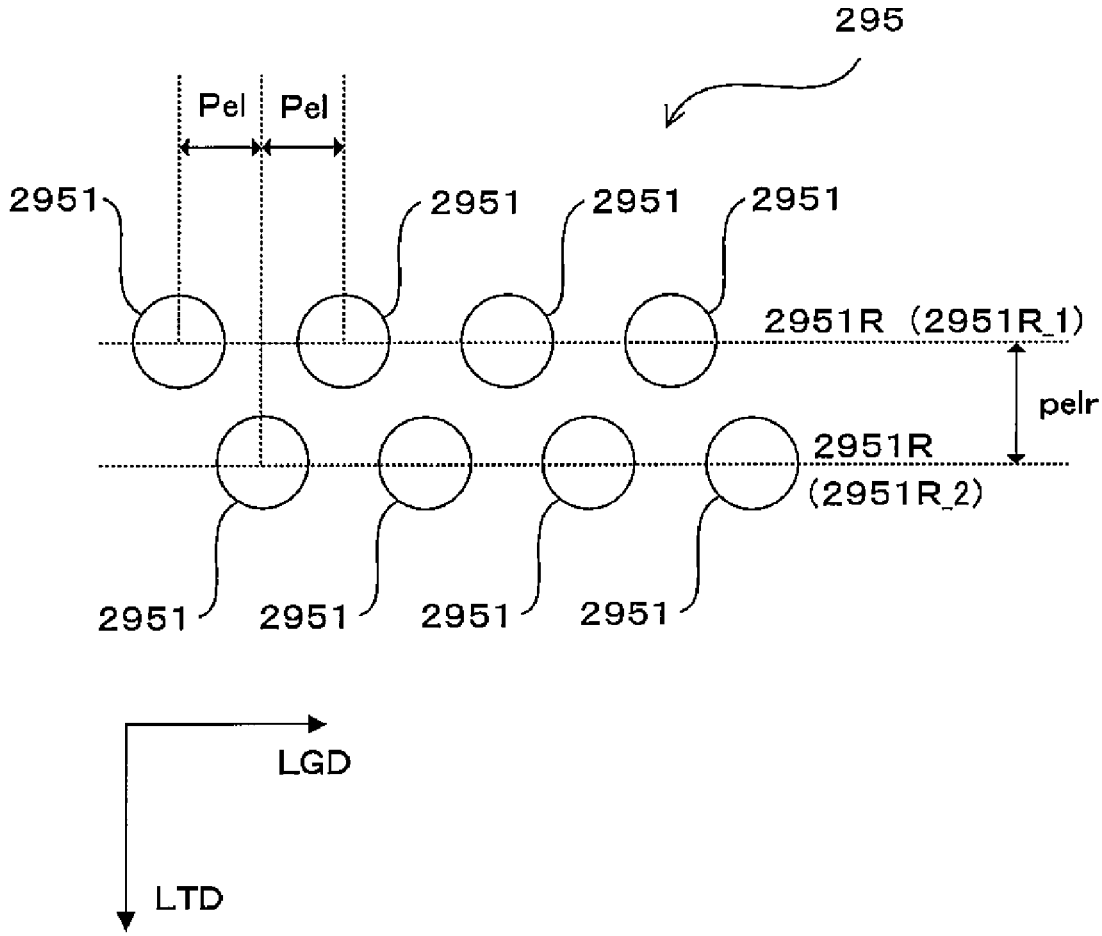
FIG. 8 is a diagram showing the arrangement of the light emitting elements in each light emitting element group.

FIG. 7 is a diagram showing the arrangement of the light emitting element groups in the line head, and FIG. 8 is a diagram showing the arrangement of the light emitting elements in each light emitting element group. The construction of the respective light emitting element groups will be described with reference to FIGS. 7 and 8. Eight light emitting elements 2951 are aligned at specified element pitches Pel in the longitudinal direction LGD in each light emitting element group 295. In each light emitting element group 295, two light emitting element rows 2951R each formed by aligning four light emitting elements 2951 at specified pitches (twice the element pitch Pel) in the longitudinal direction LGD are arranged while being spaced apart by an element row pitch Pelr in the width direction LTD. As a result, eight light emitting elements 2951 are arranged in a staggered manner in each of the light emitting element groups 295. The plurality of light emitting element groups 295 are arranged as follows.

Specifically; a plurality of light emitting element groups 295 are arranged such that a plurality of light emitting element group columns 295C, in each of which three light emitting element groups 295 are offset from each other in the width direction LTD and the longitudinal direction LGD, are arranged in the longitudinal direction LGD. Further, in conformity with such an arrangement of the light emitting element groups, a plurality of lens columns LSC, in each of which three lenses LS are offset from each other in the width direction LTD and the longitudinal direction LGD, are arranged in the longitudinal direction LGD in the lens array 299. The longitudinal-direction positions of the respective light emitting element groups 295 differ from each other, so that the respective light emitting element groups 295 can expose mutually different regions in the main scanning direction MD. A plurality of light emitting element groups 295 arranged in the longitudinal direction LGD (in other words, a plurality of light emitting element groups 295 arranged at the same width-direction position) are particularly defined as a light emitting element group row 295R. In this specification, it is defined that the position of each light emitting element is the geometric center of gravity thereof and that the position of the light emitting element group 295 is the geometric center of gravity of the positions of all the light emitting elements belonging to the same light emitting element group 295. The longitudinal-direction position and the width-direction position mean a longitudinal-direction component and a width-direction component of a particular position, respectively.

The detailed mutual relationship of the light emitting element groups 295, the light guide holes 2971 and the lenses LS is as follows. Specifically, the light guide holes 2971 are perforated in the light shielding member 297 and the lenses LS are arranged in conformity with the arrangement of the light emitting element groups 295. At this time, the center of gravity position of the light emitting element groups 295, the center axes of the light guide holes 2971 and the optical axes OA of the lenses LS substantially coincide. Accordingly, light beams emitted from the light emitting elements 2951 of the light emitting element groups 295 are incident on the lenses LS of the lens array 299 through the light guide holes 2971.

Spots are formed on the surface of the photosensitive drum 21 (photosensitive member surface) by imaging these incident light beams by the lenses LS, whereby the photosensitive member surface is exposed. A latent image is formed in the thus exposed part.

III. Terminology in Line Head

Figure 9:
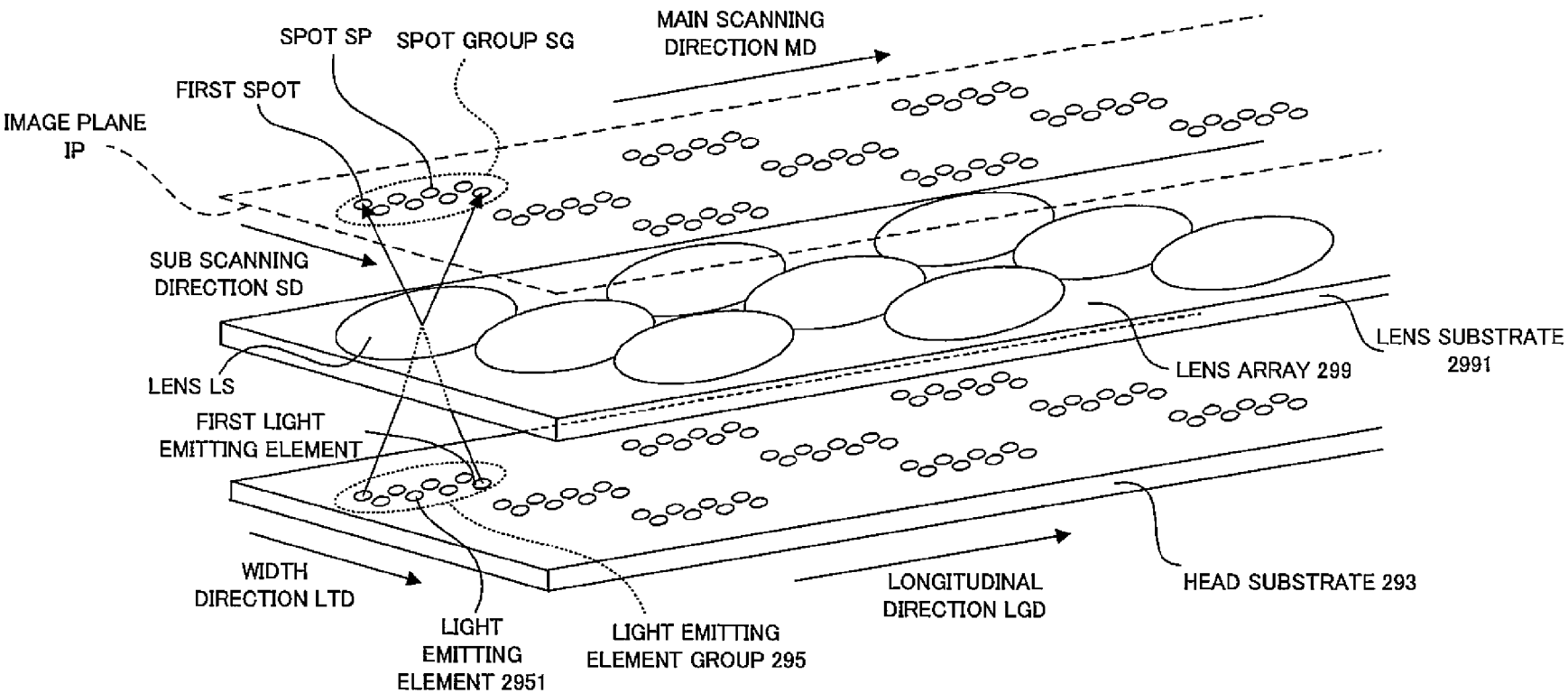
FIGS. 9 and 10 are diagrams showing terminology used in this specification.
Figure 10:
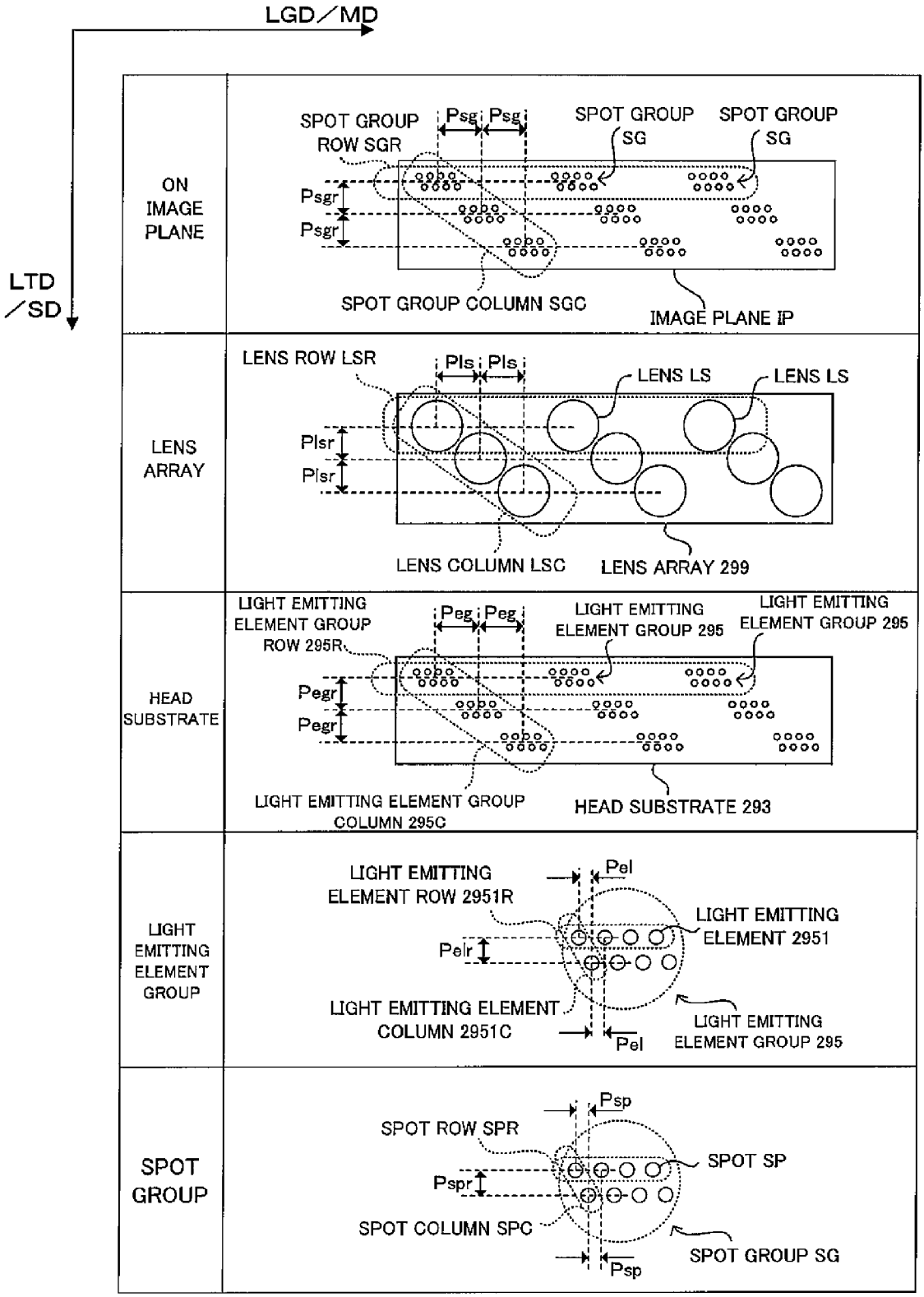

FIGS. 9 and 10 are diagrams showing terminology used in this specification. Here, terminology used in this specification is organized with reference to FIGS. 9 and 10. In this specification, as described above, a conveying direction of the surface (image plane IP) of the photosensitive drum 21 is defined to be the sub scanning direction SD and a direction substantially normal to the sub scanning direction SD is defined to be the main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 9 and 10) light emitting elements 2951 arranged on the head substrate 293 in one-to-one correspondence with the plurality of lenses LS of the lens array 299 are defined to be light emitting element groups 295. In other words, in the head substrate 293, the plurality of light emitting element groups 295 including a plurality of light emitting elements 2951 are arranged in conformity with the plurality of lenses LS, respectively. Further, collections of a plurality of spots SP formed on the image plane IP by imaging light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

Further, spot group rows SGR and spot group columns SGC are defined as shown in the column "On Image Plane" of FIG. 10. Specifically, a plurality of spot groups SG aligned in the main scanning direction MD is defined to be the spot group row SGR. A plurality of spot group rows SGR are arranged at specified spot group row pitches Psgr in the sub scanning direction SD Further, a plurality of (three in FIG. 10) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR side by side with the same pitch and that the spot group pitch Psg is a distance in the main scanning direction MD between the geometric centers of gravity of the two spot groups SG side by side with the same pitch.

Lens rows LSR and lens columns LSC are defined as shown in the column of "Lens Array" of FIG. 10. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 10) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of the two lens rows LSR side by side with the same pitch and that the lens pitch Pls is a distance in the longitudinal direction LGD between the geometric centers of gravity of the two lenses LS side by side with the same pitch.

Light emitting element group rows 295R and light emitting element group columns 295C are defined as in the column "Head Substrate"of FIG. 10. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 10) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of the two light emitting element group rows 295R side by side with the same pitch and that the light emitting element group pitch Peg is a distance in the longitudinal direction LGD between the geometric centers of gravity of the two light emitting element groups 295 side by side with the same pitch.

Light emitting element rows 2951R and light emitting element columns 2951C are defined as in the column "Light emitting element Group" of FIG. 10. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 10) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of the two light emitting element rows 2951R side by side with the same pitch and that the light emitting element pitch Pel is a distance in the longitudinal direction LGD between the geometric centers of gravity of the two light emitting elements 2951 side by side with the same pitch.

Spot rows SPR and spot columns SPC are defined as shown in the column "Spot Group" of FIG. 10. Specifically, in each spot group SG, a plurality of spots SG aligned in the longitudinal direction LGD is defined to be the spot row SPR. A plurality of spot rows SPR are arranged at specified spot row pitches Pspr in the width direction LTD. Further, a plurality of (two in FIG. 10) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of the two spot rows SPR side by side with the same pitch and that the spot pitch Psp is a distance in the main scanning direction MD between the geometric centers of gravity of the two spots SP side by side with the same pitch.

IV. Exposure Operation by Line Head

Figure 11:
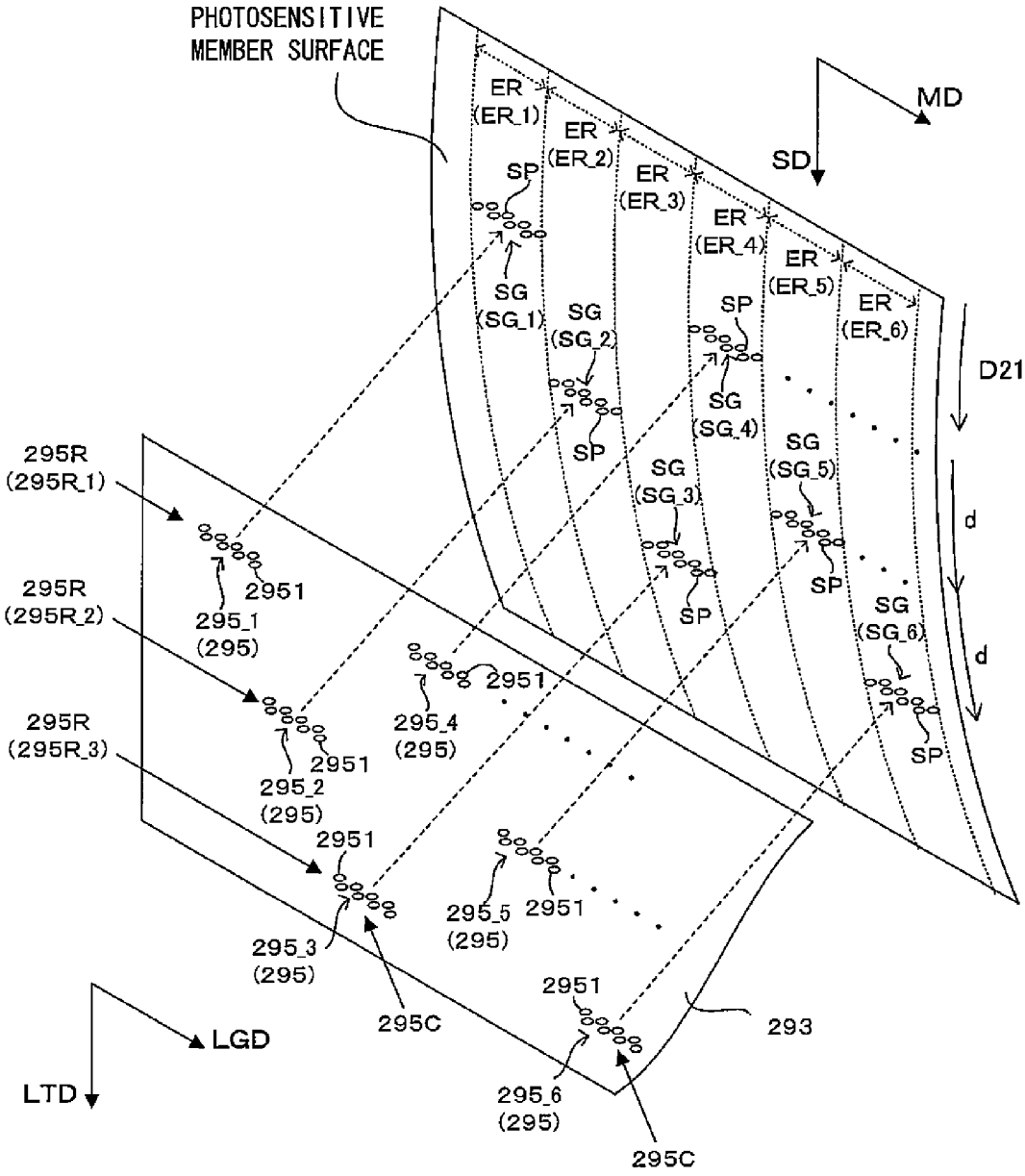
FIG. 11 is a perspective view showing an exposure operation by the line head.

FIG. 11 is a perspective view showing an exposure operation by the line head. As described above, the exposure operation is performed by the lenses LS imaging the lights from the light emitting element groups 295. In FIG. 11, the lens array is not shown. The spot groups SG described next are formed on the photosensitive member surface by imaging the lights from the light emitting element groups 295 by the lenses LS. However, in the following description, the imaging operations of the lenses LS are omitted if necessary and it is merely described that "the light emitting element groups 295 form the spot groups SG" in order to facilitate the understanding of the exposure operation. As shown in FIG. 11, the respective light emitting element groups 295 can expose mutually different regions ER (ER1 to ER6). For example, the light emitting element group 295_1 forms the spot group SG_1 on the photosensitive member surface moving in the sub scanning direction SD (moving direction D21) by emitting light beams from the respective light emitting elements 2951. In this way, the light emitting element group 2951_1 can expose the region ER_1 of a specified width in the main scanning direction MD. Similarly, the light emitting element groups 295_2 to 295_6 can exposure the regions ER_2 to ER_6.

In the line head 29, the light emitting element group column 295C is formed by offsetting three light emitting element groups 295 from each other in the width direction LTD and the longitudinal direction LGD. For example, as shown in FIG. 11, the light emitting element groups 295_1 to 295_3 constituting the light emitting element group column 295C are offset from each other in the width direction LTD. The three light emitting element groups 295 constituting the light emitting element group column 295C expose three consecutive exposure regions ER in the main scanning direction MN. In this way, the light emitting element group column 295C is formed by offsetting the light emitting element groups 295, which expose the three consecutive exposure regions ER in the main scanning direction MD, from each other in the width direction LTD. The positions of the spot groups SG formed by the light emitting element groups 295 also differ in the sub scanning direction SD in conformity with the offset arrangement of the light emitting element groups 295 in the width direction LTD.

Figure 12:
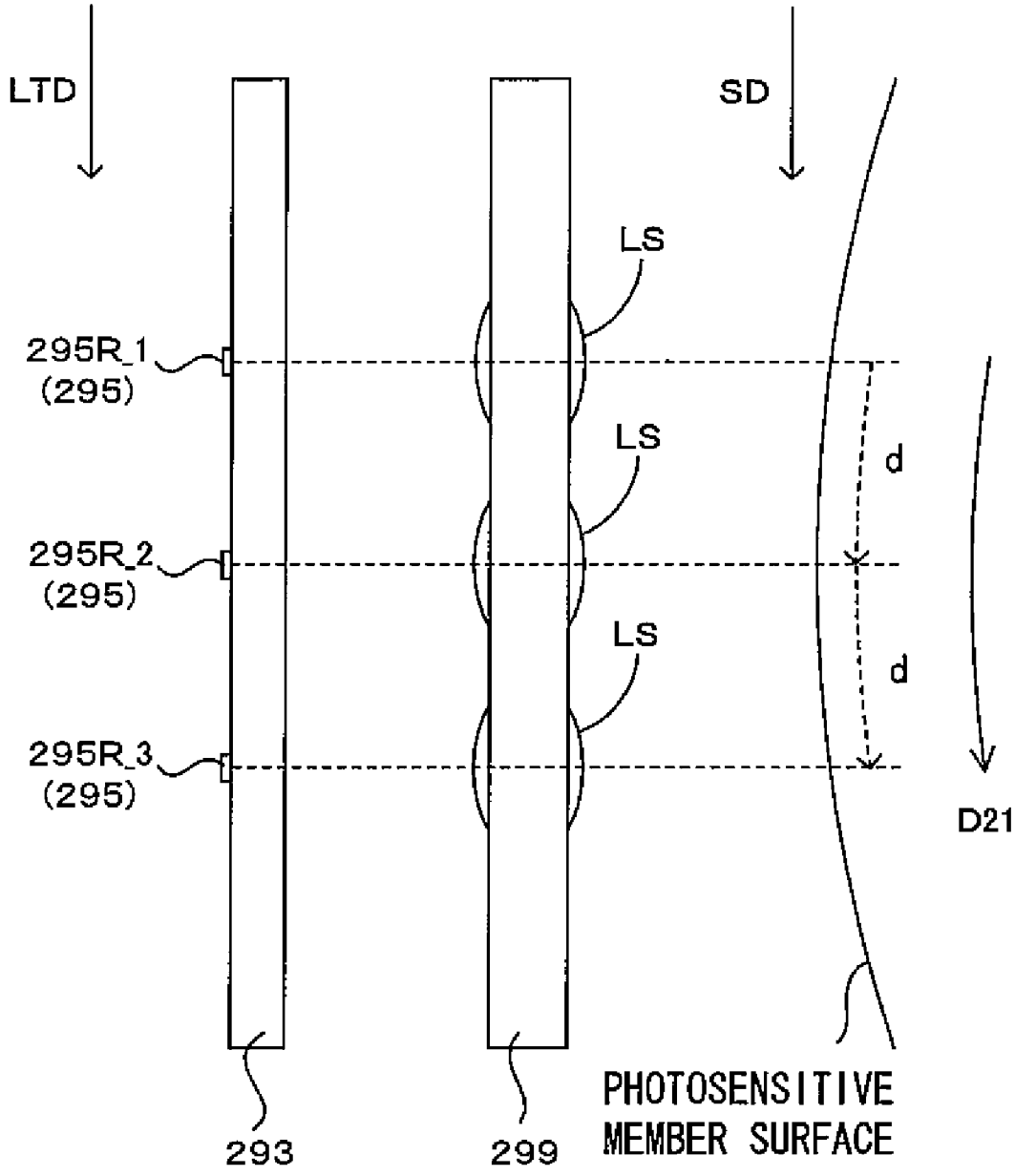
FIG. 12 is a side view showing the exposure operation by the line head.

FIG. 12 is a side view showing the exposure operation by the line head. The exposure operation by the line head will be described with reference to FIGS. 11 and 12. As shown in FIGS. 11 and 12, the light emitting element groups 295 belonging to the same light emitting element group row 295R form the spot groups SG substantially at the same positions in the sub scanning direction SD (moving direction D21). On the other hand, the light emitting element groups belonging to the mutually different light emitting element group rows 295R form the spot groups SG at mutually different positions in the sub scanning direction SD (moving direction D21). In other words, the first light emitting element group row 295R_1 in the width direction LTD forms the spot groups SG_1, SG_4 at most upstream positions in the sub scanning direction SD. The second light emitting element group row 295R_2 forms the spot groups SG_2, SG_5 at positions downstream of these spot groups SG_1 SG_4 by a distance d. Further, the third light emitting element group row 295R_3 forms the spot groups SG_3, SG_6 at positions downstream of these spot groups SG_2, SG_5 by the distance d.

The formation positions of the spot groups SG in the sub scanning direction SD differ depending on the light emitting element groups 295. Accordingly, the respective light emitting element group rows 295R emit lights at mutually different timings to form the spot groups SG, for example, in the case of forming a latent image extending in the main scanning direction MD.

Figure 13:
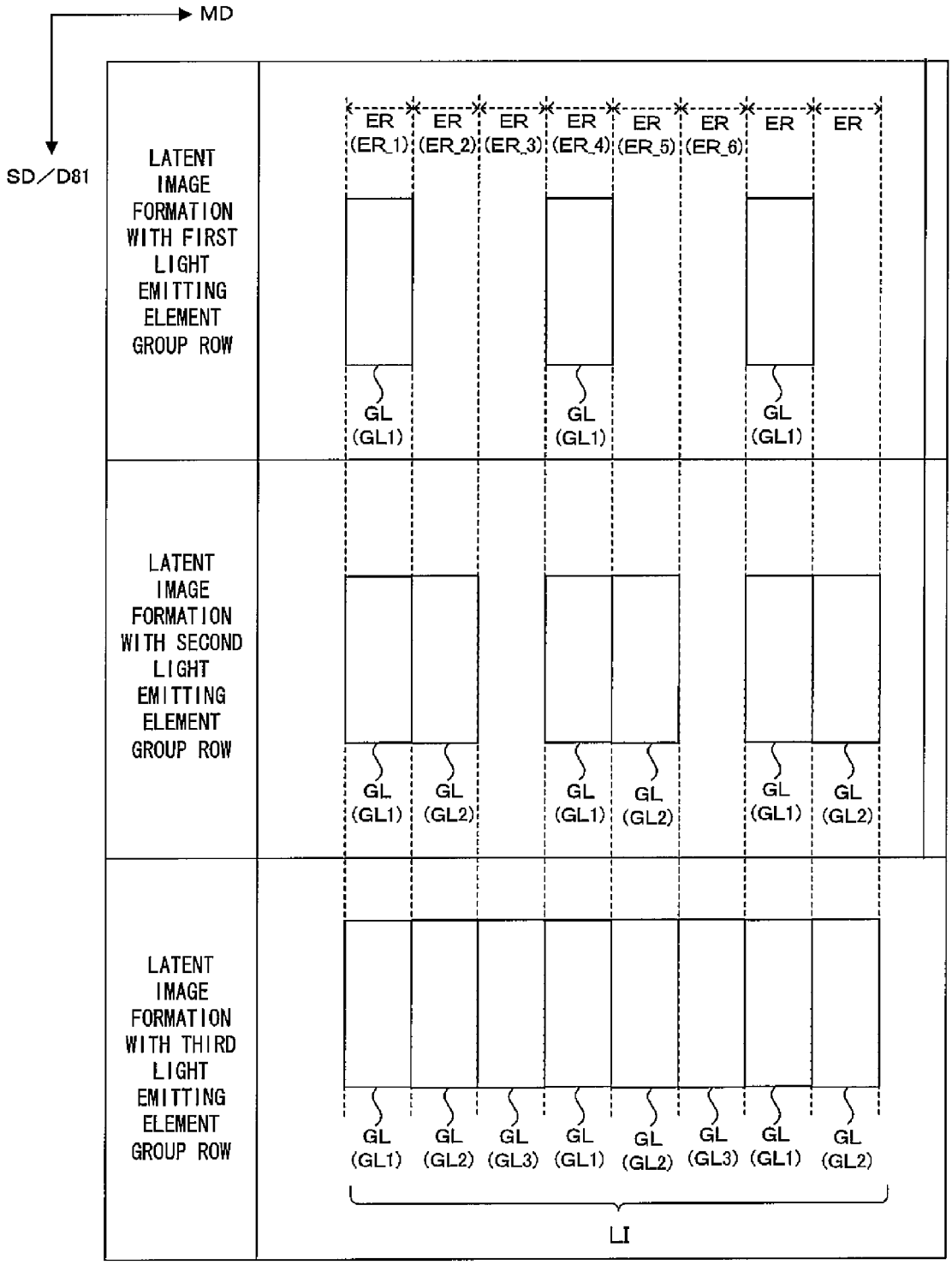
FIG. 13 is a diagram showing an example of a latent image forming operation by the line head.

FIG. 13 is a diagram showing an example of a latent image forming operation by the line head. The example of the latent image forming operation by the line head will be described below with reference to FIGS. 11 to 13. First of all, the first light emitting element group row 295R_1 forms the spot groups SG for a specified period. Thus, group latent images GL1 of a specified width are formed in the regions ER_1, ER_4, . . . in the sub scanning direction SD. Here, the group latent image GL is a latent image formed by one light emitting element group 295. Subsequently, the second light emitting element group row 295R_2 forms the spot groups SG for the specified period at a timing at which the group latent images GL1 formed by the light emitting element group row 295R_1 are conveyed in the sub scanning direction SD by the distance d. Thus, group latent images GL2 of the specified width are formed in the regions ER_2, ER_5, . . . in the sub scanning direction SD. Further, the third light emitting element group row 295R_3 forms the spot groups SG for the specified period at a timing at which the latent images formed by the light emitting element group rows 295R 1, 295R_2 are conveyed in the sub scanning direction SD by the distance d. Thus, group latent images GL3 of the specified width are formed in the regions ER_3, ER_6, . . . in the sub scanning direction SD.

In this specification, the group latent images formed by the light emitting element group row 295R_1 (in other words, by the tens row LSR1) are called group latent image GL1 and group toner images obtained by developing the group latent images GL1 are called group toner images GM1. Further, the group latent images formed by the light emitting element group row 295R_2 (in other words, by the lens row LSR2) are called group latent image GL2 and group toner images obtained by developing the group latent images GL2 are called group toner images GM2. Furthermore, the group latent images formed by the light emitting element group row 295R_3 (in other words, by the lens row LSR3) are called group latent image GL3 and group toner images obtained by developing the group latent images GL3 are called group toner images GM3.

Figure 14:
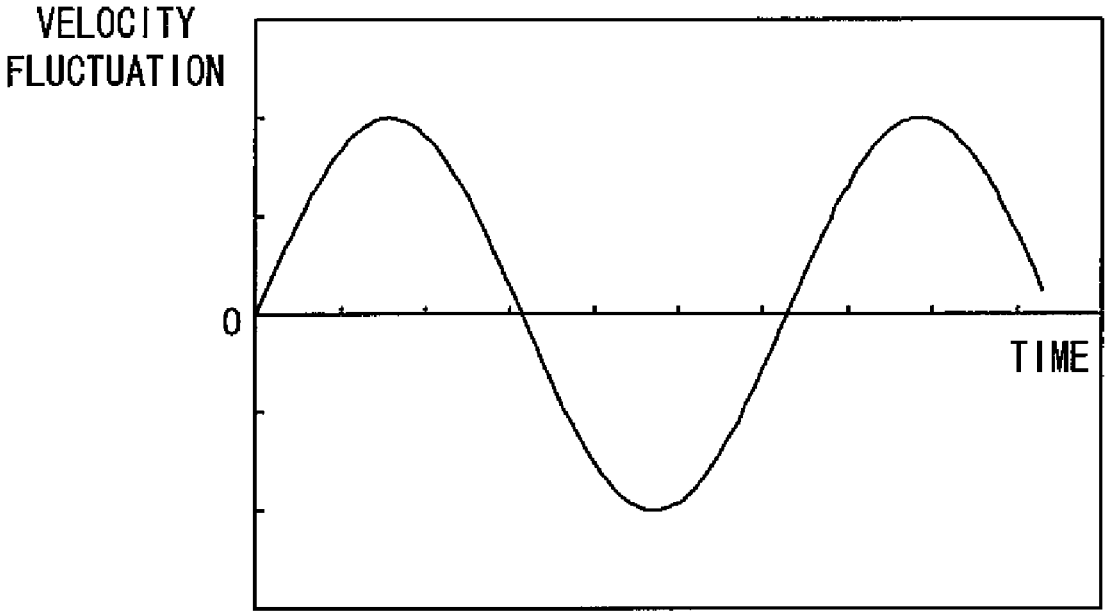
FIG. 14 is a graph showing a relationship between the speed variation of the moving speed of the photosensitive member surface and time.

The respective light emitting element group rows 295R emit lights at different timings in this way, whereby a plurality of group latent images GL1 to GL3 are consecutively formed in the main scanning direction MD to form a latent image L1 extending in the main scanning direction MD. However, a moving speed of the photosensitive member surface may vary, for example, as shown in FIG. 14 in some cases due to the eccentricity of the photosensitive drum or the like. FIG. 14 is a graph showing a relationship between the speed variation of the moving speed of the photosensitive member surface and time. As a result, the positions of the group latent images GL1 to GL3 formed by the respective light emitting element groups 295 may vary in the sub scanning direction SD in some cases.

Figure 15:
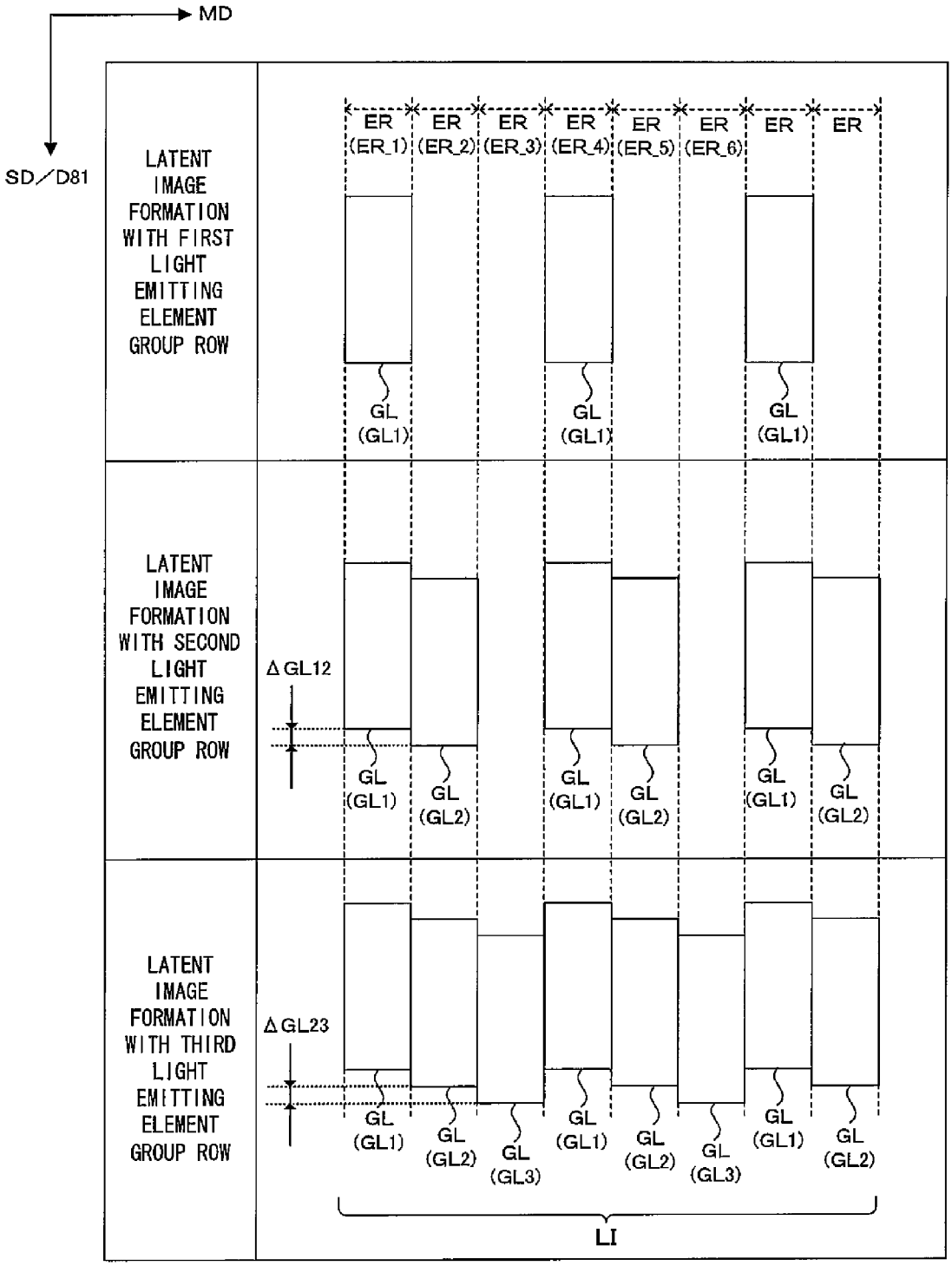
FIG. 15 is a diagram showing positional variations, which can occur in a latent image.

FIG. 15 is a diagram showing positional variations, which can occur in a latent image. As in the case shown in FIG. 13, the first light emitting element group row 295R_1 first forms the spot groups SG for the specified period to form the group latent images GL1. Subsequently, the second light emitting element group row 295R_2 forms the spot groups SG for the specified period to form the group latent images GL2. At this time, the group latent images GL2 are formed while being displaced from the group latent images GL1 by a distance ΔGL12 in the sub scanning direction SD due to the variation of the moving speed of the photosensitive member surface. Further, the third light emitting element group row 295R_3 forms the spot groups SG for the specified period to form the group latent images GL3. In this case as well, the group latent images GL3 are formed while being displaced from the group latent images GL2 by a distance ΔGL23 in the sub scanning direction SD due to the variation of the moving speed of the photosensitive member surface. In this way, the formation positions of the group latent images GL1 to GL3 may vary for the respective light emitting element groups in some cases due to the moving speed variation of the photosensitive member surface. If such positional variations of the latent images occur for the respective light emitting element groups in this way, there are cases where a test image cannot be stably detected in a color misregistration correcting operation to be described next and other operations.

V. Color Misregistration Correction Operation

A color misregistration correction operation performed by the image forming apparatus 1 will be described. Specifically, as described above, the image forming apparatus 1 forms a color image by transferring toner images of four colors in such a manner as to superimpose them on the surface of the transfer belt 81. However, in such an image forming apparatus, transfer positions on the transfer belt 81 may be displaced for the respective colors in some cases. Such a displacement appears as a color variation (color misregistration). Accordingly, the image forming apparatus 1 performs a color misregistration correction operation to satisfactorily form a color image.

Figure 16:
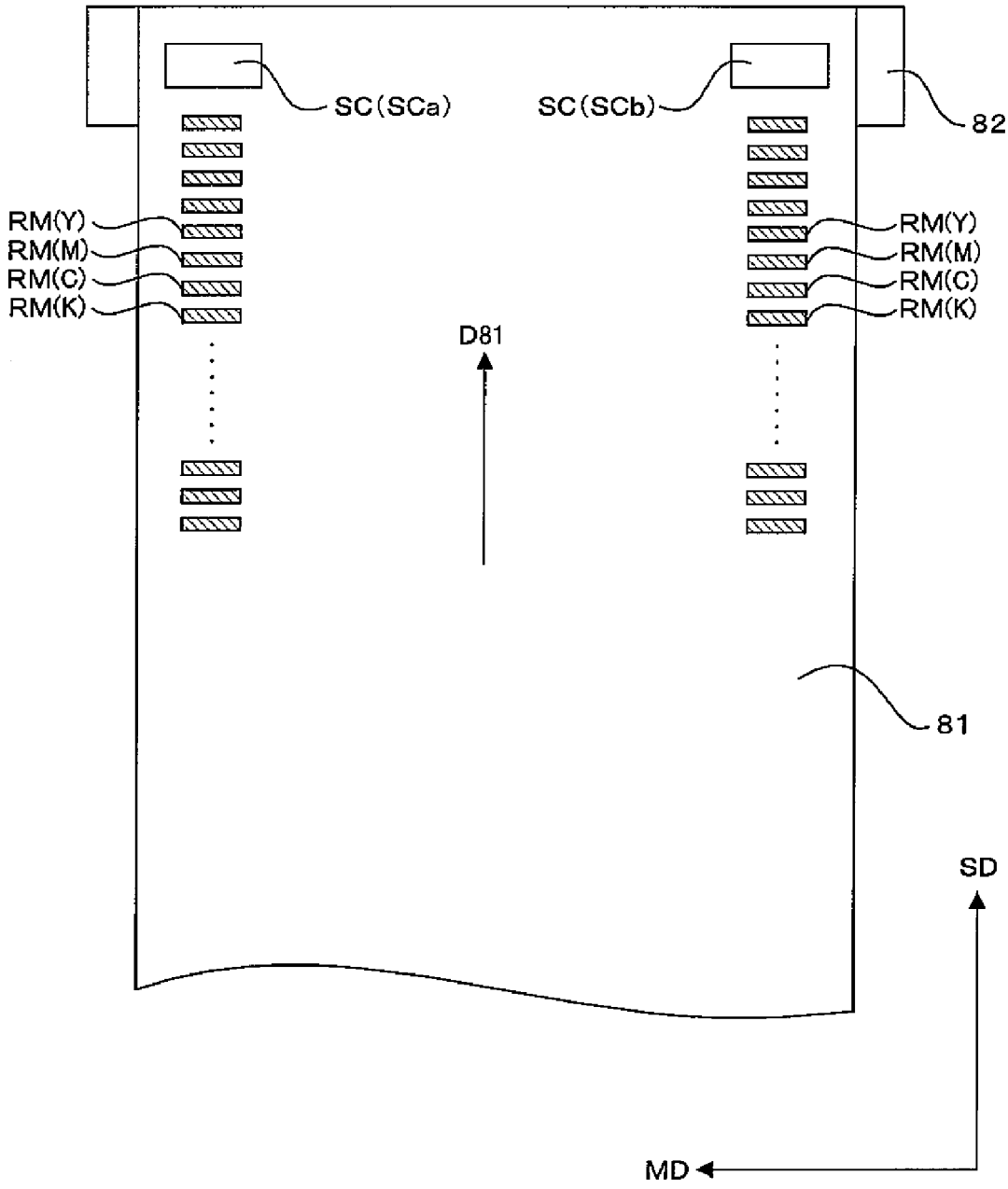
FIG. 16 is a diagram showing a construction for performing the color misregistration correction operation.

FIG. 16 is a diagram showing a construction for performing the color misregistration correction operation, and this diagram corresponds to a case when viewed vertically from below (from the lower side in FIG. 1). This color misregistration correction operation is performed using optical sensors SC. Specifically, two optical sensors SCa, SCb are arranged to face a mounted portion of the transfer belt 81 on the driving roller 82. As shown in FIG. 16, the respective optical sensors SCa, SCb are disposed at an end in the main scanning direction MD.

Figure 17:
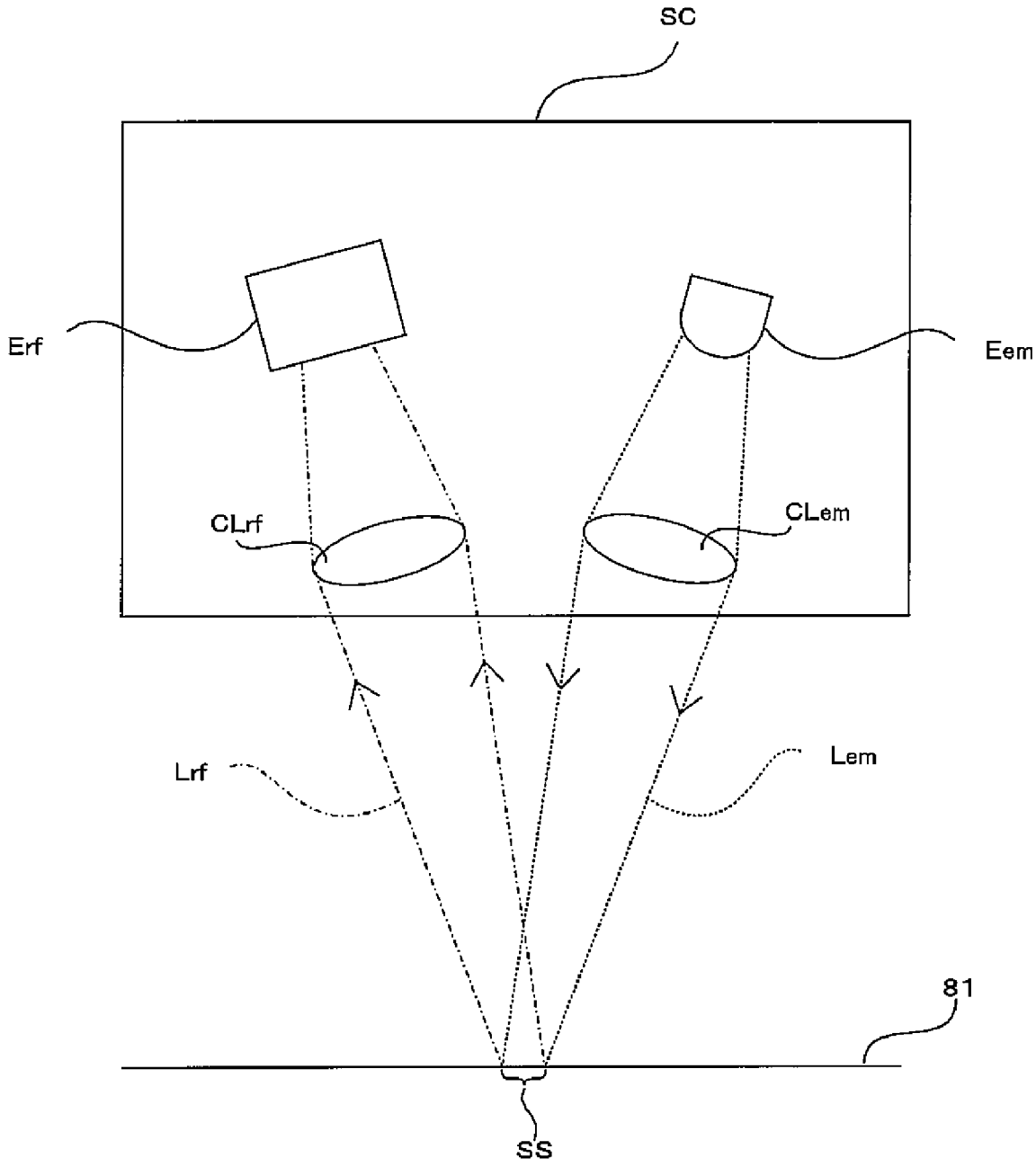
FIG. 17 is a diagram showing an example of the optical sensor.

FIG. 17 is a diagram showing an example of the optical sensor. The optical sensor SC includes a light emitter Eem for emitting an irradiated light Lem toward the surface of the transfer belt 81 and a light receiver Erf for receiving a reflected light Lrf reflected by the transfer belt 81. The optical sensor SC further includes a condenser lens CLem for condensing the irradiated light Lem emitted from the light emitter Eem and a condenser lens CLrf for condensing the reflected light Lrf reflected by the surface of the transfer belt 81. Accordingly, the irradiated light Lem emitted from the light emitter Eem is condensed on the surface of the transfer belt 81 by the condenser lens CLem. Thus, a sensor spot SS is formed on the surface of the transfer belt 81. The reflected light Lrf reflected in an area of the sensor spot SS is condensed by the condenser lens CLrf to be detected by the light receiver Erf. In this way, the optical sensor SC detects an object on the sensor spot SS. Various optical sensors conventionally proposed can be used as the optical sensor SC. So-called distance limited reflective photoelectric sensors BGS (Back Ground Suppression) and the like may be used. Such BGSs include, for example, E3Z-LL61-F805M produced by Omron Corporation. This BGS detects an object located inside the sensor spot by projecting a light beam as a sensor spot.

Figure 18:
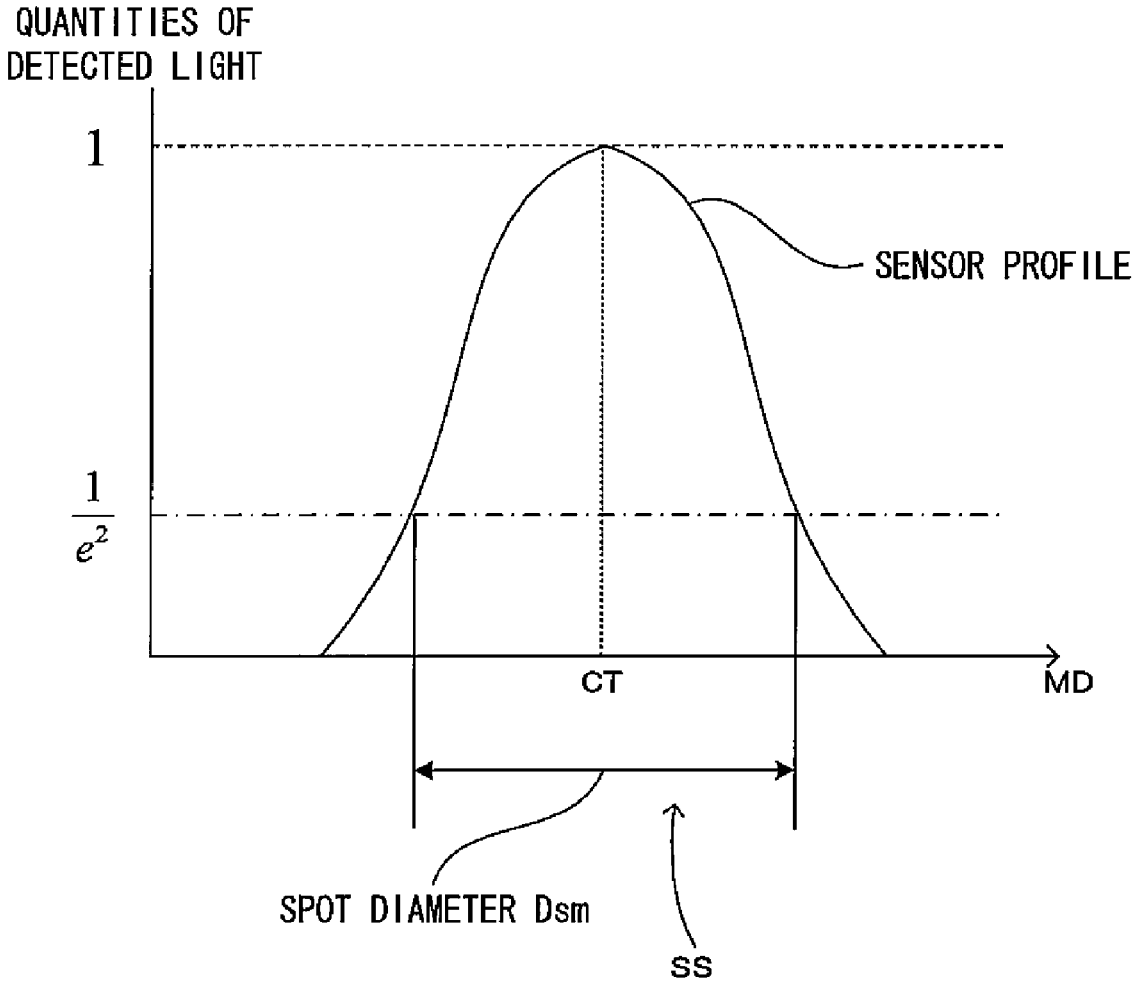
FIG. 18 is a graph of a sensor spot.

FIG. 18 is a graph of a sensor spot. An abscissa of FIG. 18 represents positions in the main scanning direction MD on the surface of the transfer belt 81. An ordinate of FIG. 18 represents the quantities of lights received (detected) by the light receiver Erf out of the reflected lights reflected at the positions represented by the abscissa on the surface of the transfer belt 81. If the quantities detected by the light receiver Erf out of the reflected lights at these positions are plotted with respect to the positions on the surface of the transfer belt 81, a sensor profile shown in FIG. 18 can be obtained. This sensor profile has a substantially laterally symmetrical distribution peaked at a profile center CT. The sensor spot SS is a range where the detected light quantity is equal to or above $1/e^2$ (e is a base of natural logarithm) in the case of normalizing the sensor profile with a peak value set at 1. Accordingly, a spot diameter Dsm in the main scanning direction of the sensor spot SS corresponds to the length indicated by arrows in FIG. 18. As described above, in this embodiment, the sensor spot SS (detection area) is not determined by the light quantity distribution on the surface of the transfer belt 81, but by a detected light quantity distribution on the light receiver Erf. Although the sensor spot SS is described with respect to the main scanning direction MD here, the content of the sensor spot SS is similar also in the sub scanning direction SD. Referring back to FIG. 16, the description of the color misregistration correction operation is continued.

In the color misregistration correction operation, registration marks RM of the respective toner colors are formed (FIG. 16). Specifically, the image forming stations Y, M, C and K form test latent images on the surfaces of the corresponding photosensitive drums 21 and develop these test images in the respective toner colors to form the registration marks RM(Y), RM(M), RM(C) and RM(K) as the test images. These registration marks RM are transferred to be arranged in a conveying direction D81 on the surface of the transfer belt 81. The registration marks RM thus formed on the transfer belt 81 are conveyed in the conveying direction D81 and detected by the optical sensors SC.

Figure 19:
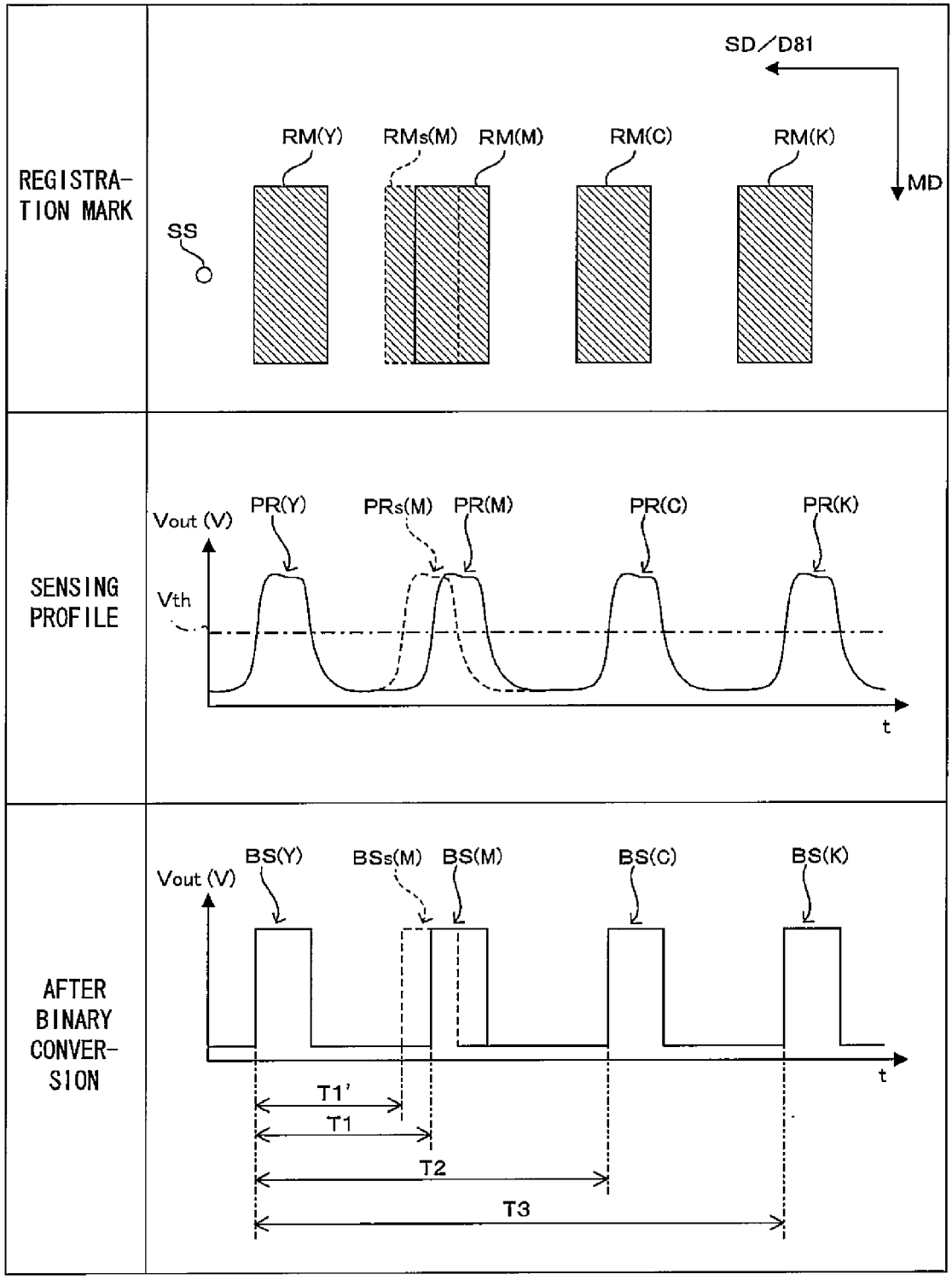
FIGS. 19 and 21 are a diagram showing a process performed based on the detection result of the optical sensor.
Figure 20:
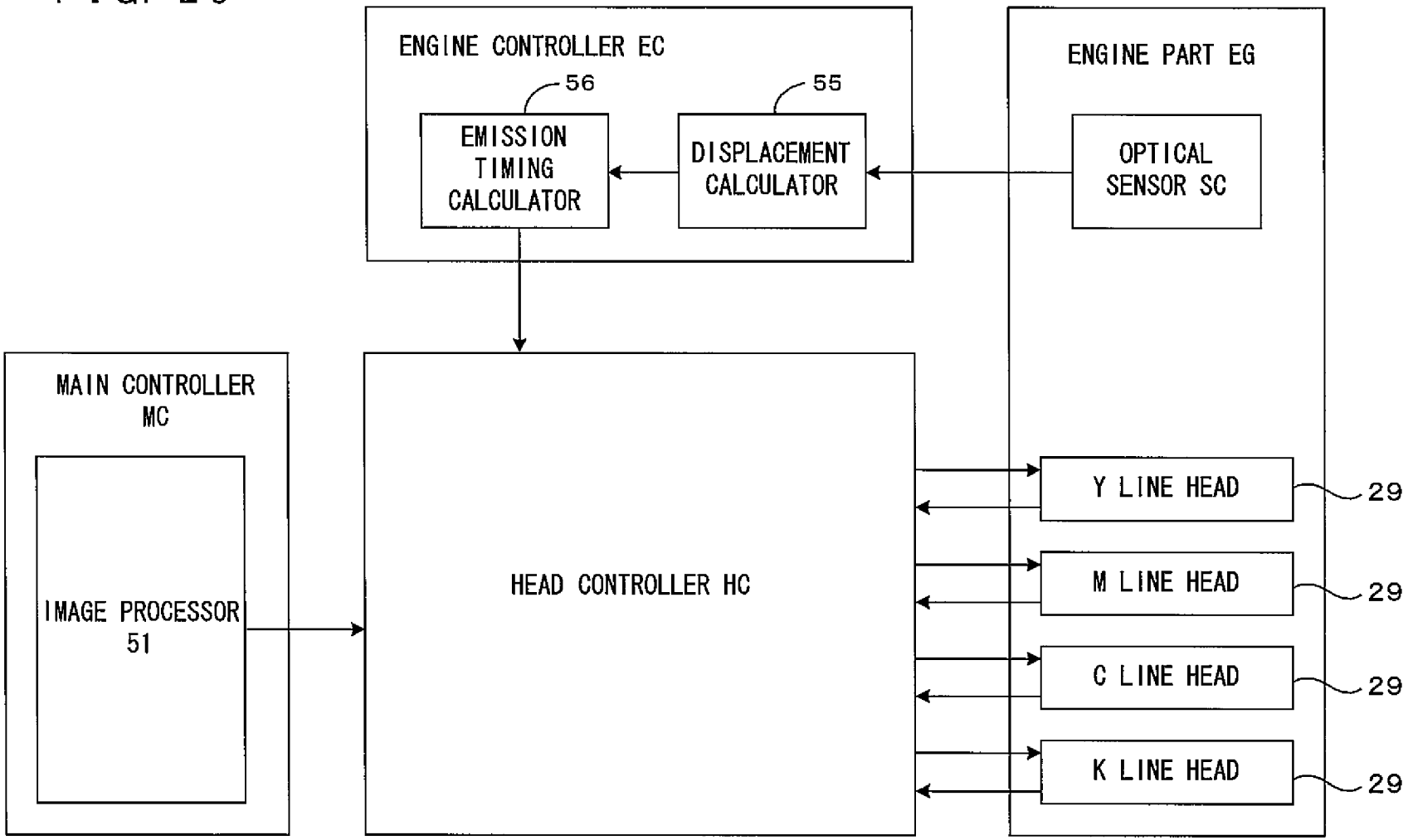
FIG. 20 is a diagram showing an electrical construction for performing the process based on the detection result of the optical sensor.

FIG. 19 is a diagram showing a process performed based on the detection result of the optical sensor, and FIG. 20 is a diagram showing an electrical construction for performing the process based on the detection result of the optical sensor. In order to facilitate the understanding of the process in the color misregistration correction operation, it is assumed here that the formation positions of only the registration marks RM of magenta (M) are displaced and the registration marks RM of the other colors are formed at ideal positions. In the row "REGISTRATION MARK" of FIG. 19, the registration marks RM(Y), RM(M), RM(C) and RM(K) shown by solid line are the registration marks of the respective colors in an ideal case free from color misregistration, and registration marks RMs(M) shown by broken line is the registration mark of magenta (M) actually displaced. As described above, the registration marks RM of the respective colors are formed side by side in the conveying direction D81 and pass the sensor spot SS by being conveyed in the conveying direction D81. In this way, the registration marks RM of the respective colors are detected by the optical sensor.

In the row "SENSING PROFILE" of FIG. 19 is shown a detection result of the optical sensor SC. When the registration marks RM(Y), RM(M), RM(C) and RM(K) pass the sensor spot SS, the optical sensor SC outputs detected waveforms PR(Y), PR(M), PR(C) and PR(K) corresponding to the respective registration marks to a displacement calculator 55. These detected waveforms are outputted as voltage signals. In an example shown in FIG. 19, the registration mark of magenta (M) is displaced. Accordingly, the optical sensor SC actually detects the registration mark RMs(M) shown by broken line and outputs a detected waveform PRs(M). This displacement calculator 55 and an emission timing calculator 56 to be described later are both provided in the engine controller EC.

In the displacement calculator 55, the detected waveforms PR(Y), PR(M), PR(C) and PR(K) outputted from the optical sensor SC are converted into binary values using a threshold voltage Vth to obtain binary signals BS(Y), BS(M), BS(C) and BS(K) as shown in the row "AFTER BINARY CONVERSION" of FIG. 19. In the example shown in FIG. 19, the registration mark of magenta (M) is displaced. Accordingly, the displacement calculator 55 generates a binary signal BSs (M) shown by broken line by converting the detected waveform PRs(M) into a binary value. The displacement of the formation position of the registration mark RMs(Q) of magenta (M) is calculated from a time interval (time interval Tym) between a rising edge of the binary signal BS(Y) of yellow (Y) as a reference and a rising edge of the binary signal BS of magenta (M). In other words, if Dm : displacement of the registration mark RMs(M) relative to the registration mark RM(Y), S81: conveying velocity of the surface of the transfer belt, T1 time interval Tym in the absence of displacement T1': time interval Tym in the presence of displacement, the displacement Dm of magenta (M) is calculated by the following equation.

$$Dm=S81\times(T1-T1')$$

The displacement Dm thus calculated is outputted to the emission timing calculator 56, which then calculates an optimal emission timing based on the displacement Dm. The light emission of the line head 29 is controlled based on the thus calculated emission timing to correct the color misregistration.

As described above, in the color misregistration correction operation, the test latent images are formed on the photosensitive member surface and are developed to form the registration marks RM as the test images on the surface of the transfer belt. Then, the registration marks RM are detected by the optical sensor SC and the color misregistration is corrected based on the detection values. As described above with reference to FIG. 15, etc., there are cases where the positions of the latent images vary for the respective light emitting element groups due to a variation of the moving speed of the photosensitive member surface. Accordingly, such a positional variation may occur also in the test latent images formed in the color misregistration correction. A similar variation may occur also in the registration marks RM (test images) obtained by developing the test latent images with such a positional variation. In other words, as shown in FIG. 21 to be described later, there have been cases where the positions of the toner images corresponding to the respective light emitting element groups vary and the detection results on the registration marks RM by the optical sensor SC are unstable.

Figure 21:
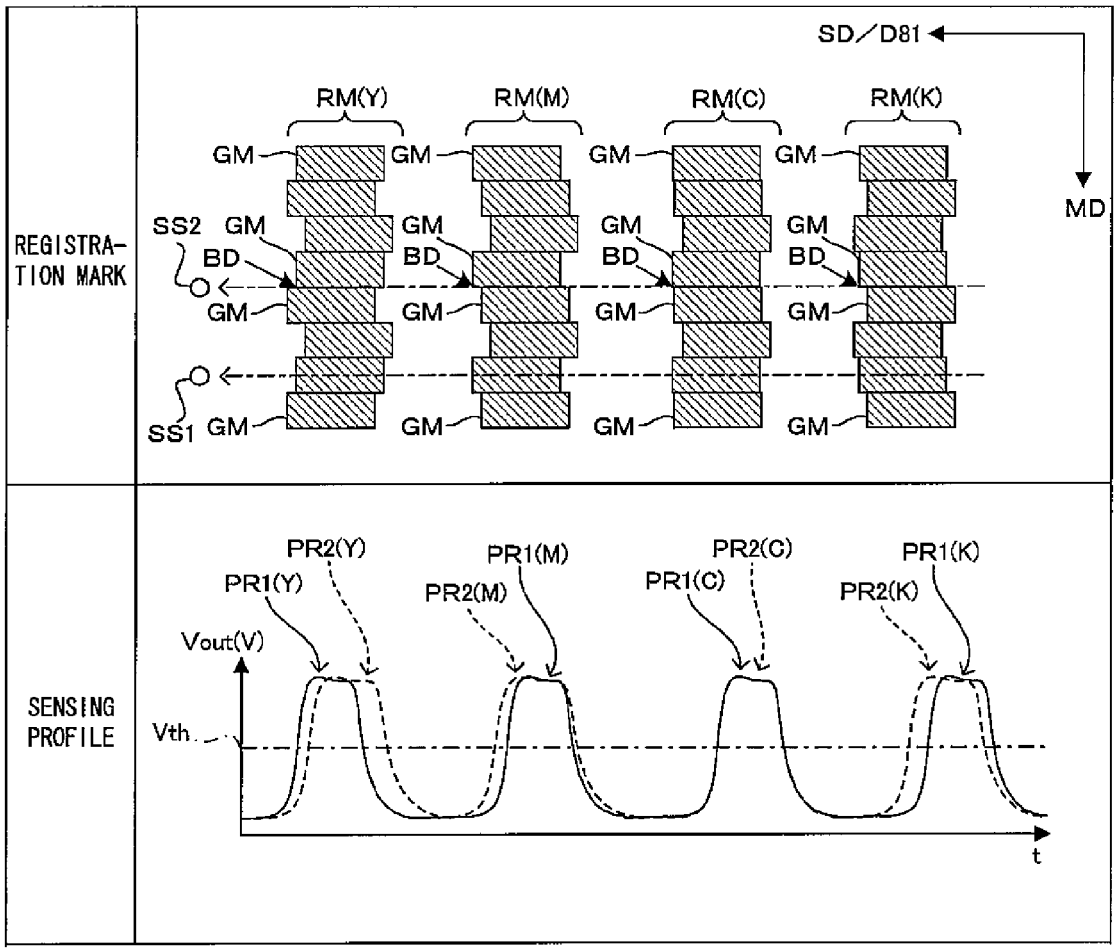

FIG. 21 is a diagram showing an example of the detection results by the optical sensors for the registration marks whose positions vary for the respective light emitting element groups. In the row "REGISTRATION MARK" of FIG. 21, laterally long rectangles represent group toner images GM obtained by developing the group latent images. As shown in this row, the positions of the group toner images GM vary in the conveying direction D81 (sub scanning direction SD) for the respective light emitting element groups also in any of the registration marks RM(Y), RM(M), RM(C) and RM(K) of the respective colors. Here, a case of detecting such registration marks RM by the sensor spot SS1 and a case of detecting them by the sensor spot SS2 are compared. Through this comparison, the reason why the detection results of the optical sensors SC are unstable will be described.

The respective registration marks RM(Y), RM(M), RM(C) and RM(K) are conveyed in the conveying direction D81 to pass the sensor spots SS1, SS2. At this time, as shown in the row "REGISTRATION MARK" of FIG. 21, a boundary potion BD of two group toner images GM adjacent in the main scanning direction MD passes the sensor spot SS2. On the other hand, not such a boundary potion BD, but a substantially central portion of one group toner image GM passes the sensor spot SS1. As a result) the detection results by the respective sensor spots SS1, SS2 are as shown in the row "SENSING PROFILE" of FIG. 21. In other words, detected waveforms PR1(Y), PR1(M), PR1(C) and PR1(K) of the respective registration marks RM by the sensor spot SS1 are substantially identically shaped and stable. On the other hand, detected waveforms PR2(Y), PRc2(M), PR2(C) and PR2(K) of the respective registration marks RM by the sensor spot SS2 have mutually different shapes. This results from the distortions of the detected waveforms PR2 by the sensor spot SS2 due to the influence of the boundary portions BD. In this way, the detected waveforms PR2 (detection results) by the sensor spot SS2 are distorted due to the influence of the boundary portions BD and are unstable. As a result, there have been cases where the color misregistration correction operation cannot be properly performed.

Figure 22:
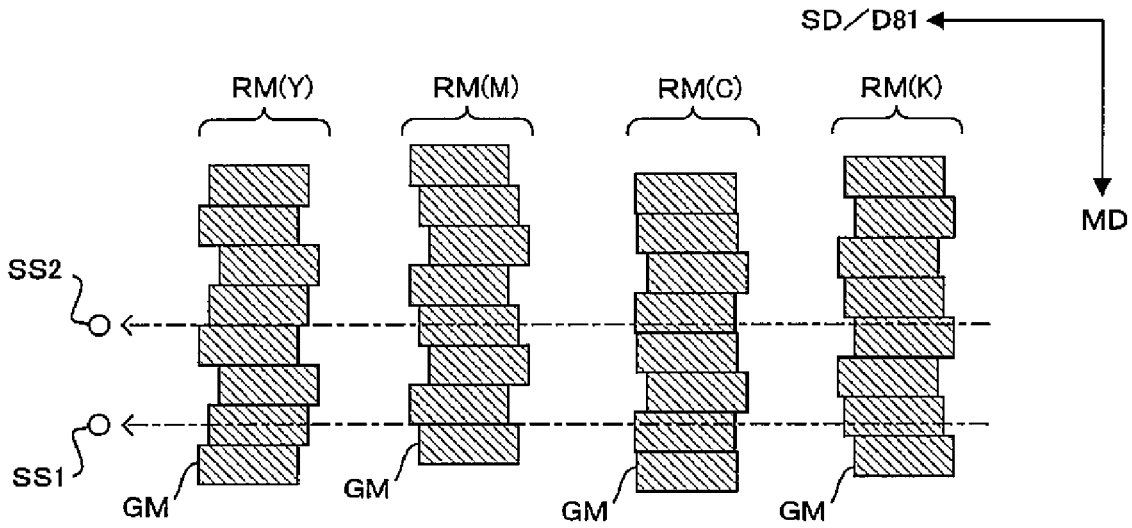
FIG. 22 is a diagram showing a case where the formation positions of the respective registration marks are displaced in the main scanning direction.

As one of approaches for suppressing the occurrence of such a problem, it can be thought to adjust the positions of the sensor spots so as not to detect the boundary portions BD. However, in the so-called tandem image forming apparatus including the four image forming stations Y (for yellow), M (for magenta), C (for cyan) and K (for black) arranged along the transfer belt 81, the mounted positions of the line heads 29 with respect to the photosensitive drums 21 may vary in the respective image forming stations. As a result, as shown in FIG. 22, there is a possibility of displacing the formation positions of the registration marks RM(Y), RM(M), RM(C) and RM(K) of the respective colors. FIG. 22 is a diagram showing a case where the formation positions of the respective registration marks are displaced in the main scanning direction. Therefore, the adjustment of the positions of the sensor spots so as not to detect the boundary portions BD may not be necessarily suitable depending on the cases.

Accordingly, in the embodiment of the invention, the sensor spot SS of the optical sensor SC is formed as described below

VI-1. First Embodiment

Figure 23:
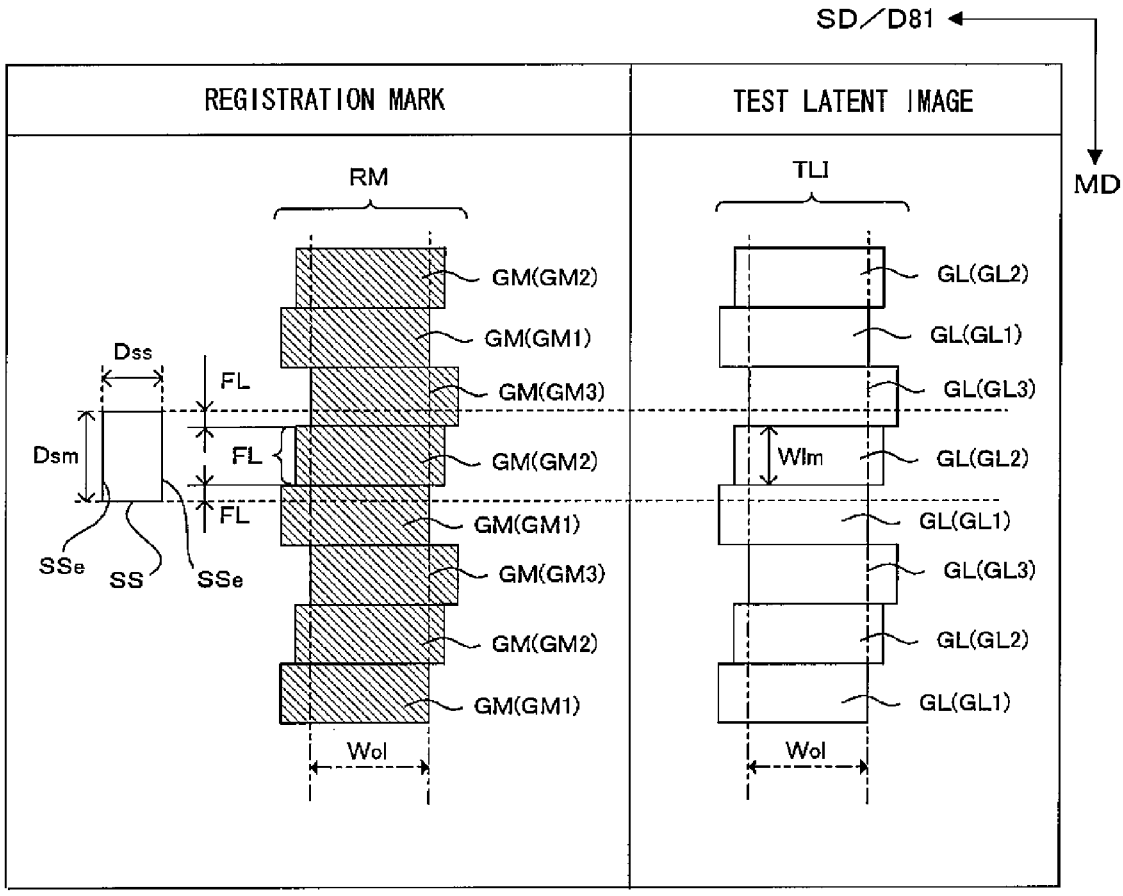
FIG. 23 is a diagram showing a relationship of a sensor spot of an optical sensor according to a first embodiment with a test image and a registration mark.

FIG. 23 is a diagram showing a relationship of a sensor spot of an optical sensor according to a first embodiment with a test image and a registration mark. The configurations of the sensor spot, the test image and the registration mark are described below through the description of the color misregistration correction operation. As described above, in the color misregistration correction operation, a test latent image TLI is first formed. In the first embodiment, this test latent image TLI is formed to have a width wider than a unit width Wlm in the main scanning direction MD. Here, the unit width Wlm is the width of the group latent image GL in the main scanning direction MD in the case where the group latent images GL are formed by all the light emitting elements 2951 belonging to one light emitting element group 295. Specifically, the test latent image TLI is made up of eight group latent images GL consecutive in the main scanning direction MD, and the respective group latent images GL are formed to have the unit width Wlm in the main scanning direction MD. Accordingly, the test latent image TLI has a width, which is the eightfold of the unit width Wlm, in the main scanning direction MD. Further, as shown in FIG. 23, this test latent image TLI is wider than the sensor spot SS in the main scanning direction MD. The eight group latent images GL are formed at varying positions in the sub scanning direction SD and overlap with an overlapping width Wol in the sub scanning direction SD. In the first embodiment, the respective eight group latent images GL are formed by all the light emitting elements 2951 belonging to one light emitting element group 295.

This test latent image TLI is developed with toner to form the registration mark RM as a test image (test image forming step, image forming step). Such a registration mark RM is shaped substantially similar to the test latent image TLI. In other words, the registration mark RM is wider than the unit width Wlm and the sensor spot SS in the main scanning direction MD. Eight group toner images GM constituting the registration mark RM vary in the sub scanning direction SD and overlap with the overlapping width Wol in the sub scanning direction SD. This registration mark RM passes the sensor spot SS in the sub scanning direction SD (conveying direction D81) to be detected by the optical sensor SC (detecting step). The sensor spot SS has a substantially rectangular shape, and both ends SSe of the sensor spot SS in the sub scanning direction SD are straight lines parallel to or substantially parallel to the main scanning direction MD. The sensor spot SS has a main-scanning spot diameter Dsm wider than the unit width Wlm in the main scanning direction MD and a sub-scanning spot diameter Dss narrower than the overlapping width Wol in the sub scanning direction SD. In the first embodiment, the main-scanning spot diameter Dsm is set larger than the sub-scanning spot diameter Dss.

In this way, the sensor spot SS has the main-scanning spot diameter Dsm wider than the unit width Wlm in the main scanning direction MD in the first embodiment. Accordingly, even if the formation positions of the respective group toner images GM vary, it is possible to stabilize the detection result on the registration mark RM by the sensor spot SS. The reason for this will be described.

As described with reference to FIG. 21, there have been cases where the detection result by the sensor spot SS2 is unstable due to the influence of the boundary potion BD of the adjacent group toner images GM. The detection result becomes unstable due to the influence of this boundary potion BD mainly because the spot diameter of the sensor spot SS2 in the main scanning direction MD is not sufficient. In other words, because of the short spot diameter of the sensor spot SS2, the detection result by the sensor spot SS2 is easily influenced by the boundary potion BD, with the result that the detection result becomes unstable.

On the contrary, as shown in FIG. 23, the sensor spot SS has the main-scanning spot diameter Dsm wider than the unit width Wlm in the main scanning direction MD in the first embodiment. Such a sensor spot SS can reliably detect a flat portion FL having the unit width Wlm and extending straight in the main scanning direction MD over a range wider than the unit width Wlm. In other words, in the optical sensor SC having the sensor spot SS shown in FIG. 23, the influence of the boundary potion BD can be relatively reduced by sufficiently reflecting such a flat portion FL on the detection result. Therefore, the optical sensor SC in the first embodiment is preferable since it can stably detect the registration mark RM.

In the first embodiment, a plurality of group latent images GL constituting the test latent image TLI are formed while overlapping with the overlapping width Wol in the sub scanning direction SD, with the result that the group toner images GM constituting the registration mark RM similarly overlap with the overlapping width Wol in the sub scanning direction SD. The sensor spot SS has the sub-scanning spot diameter Dss shorter than the overlapping width Wol in the sub scanning direction SD. Therefore, in the first embodiment, a detection signal of the optical sensor SC can be made stable. The reason for this is described below.

Figure 24:
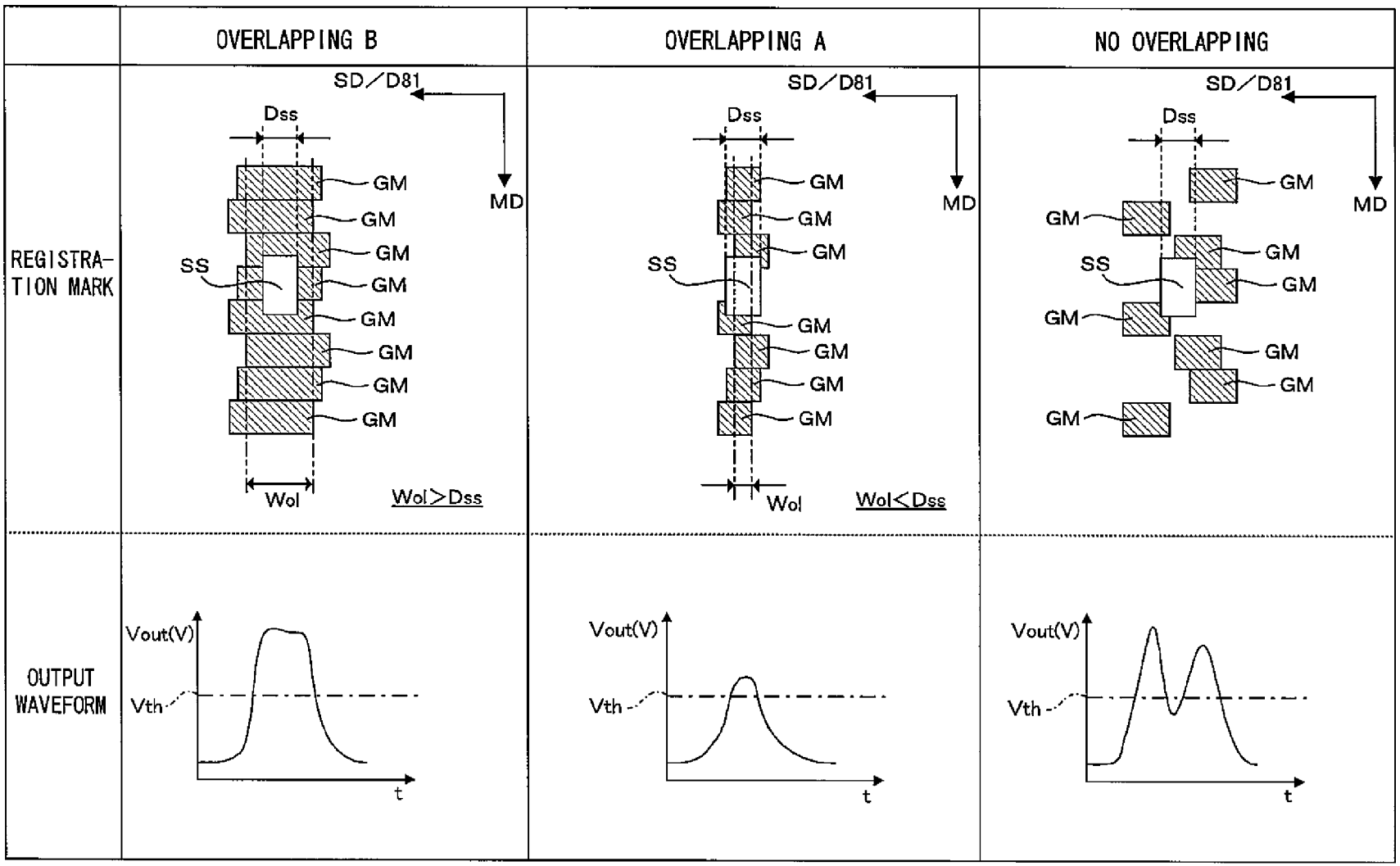
FIG. 24 is a diagram showing the influence of the overlapping width of the group toner images on the optical sensor.

FIG. 24 is a diagram showing the influence of the overlapping width of the group toner images or group latent images on the optical sensor SC. In the column "NO OVERLAPPING" of FIG. 24 is shown a case where the group toner images GM do not overlap in the registration mark RM (see "REGISTRATION MARK" in the upper part of this column). In this case, as shown in the lower part "OUTPUT WAVEFORM" of this column, an output waveform of the optical sensor SC is a double-peaked waveform and passes the threshold voltage Vth four times. Therefore, such an output waveform cannot be suitably converted into a binary value.

In the column "OVERLAPPING A" of FIG. 24 is shown a case where a plurality of group toner images GM overlap with the overlapping width Wol in the sub scanning direction SD in the registration mark RM (see "REGISTRATION MARK" in the upper part of this column). In this case, as shown in the lower part "OUTPUT WAVEFORM" of this column, a problem of the double-peaked output waveform of the optical sensor SC is solved. However, in this column, the overlapping width Wol is shorter than the sub-scanning spot diameter Dss of the sensor spot SS. As a result, the amplitude of the output waveform is relatively small.

In the column "OVERLAPPING B" of FIG. 24 is shown a case where a plurality of group toner images GM overlap with the overlapping width Wol in the sub scanning direction SD in the registration mark RM (see "REGISTRATION MARK" in the upper part of this column). Accordingly, as shown in the lower part "OUTPUT WAVEFORM" of this column, a problem of the double-peaked output waveform of the optical sensor SC is solved. In an example shown in this column, the overlapping width Wol is longer than the sub-scanning spot diameter Dss of the sensor spot SS. Accordingly, the sensor spot SS can be completely accommodated in the registration mark RM. As a result, the amplitude of the output waveform is relatively large (has a larger value as compared with the amplitude of the output waveform shown in the column "OVERLAPPING A").

As described above, the group toner images GM constituting the registration mark RM overlap with the overlapping width Wol wider than the sub-scanning spot diameter Dss, whereby the amplitude of the output waveform of the optical sensor SC increases and becomes unlikely to be influenced by, e.g. noise. Thus, the detection signal is more stable. Therefore, the first embodiment having such a construction is preferable.

In the first embodiment, the main-scanning spot diameter Dsm is set wider than the sub-scanning spot diameter Dss. Accordingly, the sensor spot SS can be completely accommodated in the registration mark RM with sufficient margins. Therefore, the detection result of the optical sensor SC can be made more stable.

In the first embodiment, the both ends SSe of the sensor spot SS in the sub scanning direction SD are straight lines parallel to or substantially parallel to the main scanning direction MD. Accordingly, the toner images located at the same position in the sub scanning direction SD reach the ends SSe of the sensor spot SS substantially at the same timing to be detected by the optical sensor SC. Therefore, the position of the registration mark RM by the optical sensor SC can be more appropriately detected.

VI-2. Second Embodiment

Figure 25:
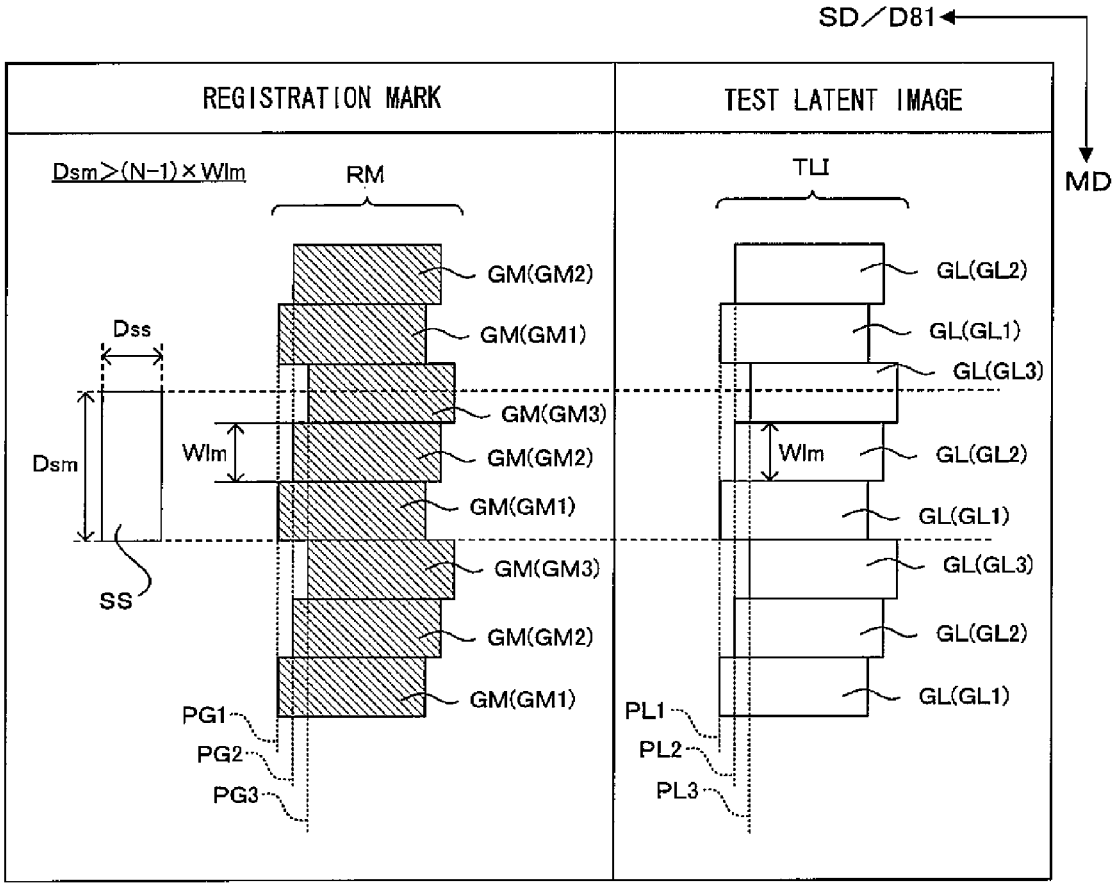
FIG. 25 is a diagram showing a relationship of a sensor spot of an optical sensor according to a second embodiment with a test image and a registration mark.

FIG. 25 is a diagram showing a relationship of a sensor spot of an optical sensor according to a second embodiment with a test image and a registration mark. In the second embodiment, the widths of a test latent image TLI, a registration mark RM and a sensor spot SS in the main scanning direction MD are set according to a number J of light emitting element groups 295 constituting a light emitting element group column 295C, i.e. a number J of lenses LS constituting a lens column LSC. Here, J is an integer equal to or greater than 3. In other words, the test latent image TLI, the registration mark RM and the sensor spot SS have the widths in the main scanning direction MD wider than the sum (=Wlm+Wlm) of the widths of images (e.g. group toner images GM1, GM2 or group toner images GM2, GM3, etc.) respectively formed by (J−1) lenses LS, which are adjacent in the main scanning direction MD and capable of exposure, in the main scanning direction MD. In other words, it can be said that the widths of the test latent image, the registration mark and the sensor spot are set in view of the width determined by an integral multiple of the unit width Wlm as described next. The configurations of such sensor spot, test latent image and registration mark are described below through the description of the color misregistration correction operation. As described above, in the color misregistration correction operation, the test latent image TLI is first formed. In the second embodiment, this test latent image TLI is formed by N or more group latent images GL adjacent and consecutive in the main scanning direction MD. Further, the respective group latent images GL are formed to have the unit width Wlm in the main scanning direction MD. Accordingly, this test latent image TLI has a width wider than the (N−1)-fold of the unit width Wlm in the main scanning direction. Here, N is an integer equal to or greater than 2 and corresponds to the number of the light emitting element group rows 295R or the number of the light emitting element groups 295 constituting one light emitting element group column 295C (in other words, N corresponds to the number of the lens rows LSR or the number of the lenses LS constituting one lens column LSC). Specifically, in this embodiment, the test latent image TLI is wider (eightfold of the unit width Wlm) than the two-fold of the unit width Wlm in the main scanning direction MD since there are three light emitting element group rows 295R. This test latent image TLI is developed to form the registration mark RM, which is detected in the sensor spot SS.

As shown in FIG. 25, a main-scanning spot diameter Dsm of the sensor spot SS is wider than the (N−1)-fold of the unit width Wlm in the second embodiment. Specifically, the main-scanning spot diameter Dsm of the sensor spot SS is wider than the twofold of the unit width Wlm. Therefore, the detection result on the registration mark RM by the sensor spot SS can be made more stable. The reason for this will be described next.

The formation positions of a plurality of group latent images GL constituting the test latent image TLI differ from each other mainly because of a speed variation of the photosensitive member surface as described above. In other words, in the above line head 29, the three light emitting element group rows 295R respectively form the group latent images GL at specified timings to form the test latent image TLI extending in the main scanning direction MD. Accordingly, if the speed of the photosensitive member surface varies during a period from the formation of the group latent images GL by a certain light emitting element group row 295R to the formation of the group latent images GL by the succeeding light emitting element group row 295R, the positions of the group latent images GL formed by the different light emitting element group rows 295R are displaced from each other. For example, as shown in FIG. 25, formation positions PL1, PL2, PL3 of the group latent images GL1, GL2, GL3 formed by the three light emitting element group rows 295R_1, 295R_2, 295R_3 are displaced from each other in the sub scanning direction SD. On the other hand, such a positional variation is hardly present between the group latent images GL formed by the same light emitting element group row 295R. In other words, in FIG. 25, the formation positions of a plurality of group latent images GLl formed by the first light emitting element group row 295R_1 are all aligned at the position PL1. This holds true for the other light emitting element group rows 295R_2, 295R_3.

In the registration mark RM obtained by developing such a test latent image TLI, a similar positional variation occurs between the group toner images GM. In other words, the positional variation occurs between the group toner images GM formed by the mutually different light emitting element group rows 295R, whereas it hardly occurs between the group toner images GM formed by the same light emitting element group rows 295R. Specifically, as shown in the column "REGISTRATION MARK" of FIG. 25, the formation positions PG1, PG2, PG3 of the group toner images GM1, GM2, GM3 formed by the three light emitting element group rows 295$R_{13}$ 1, 295R_2, 295R_3 are displaced from each other in the sub scanning direction SD.

In this way, displacements of the group toner images GM main occur between the different light emitting element group rows 295R. Accordingly, in the line head 29 having, for example, N light emitting element group rows 295, the following situation as shown in FIG. 26 may possibly occur if the main-scanning spot diameter Dsm of the sensor spot SS is narrower than the (N−1)-fold of the unit width Wlm.

Figure 26:
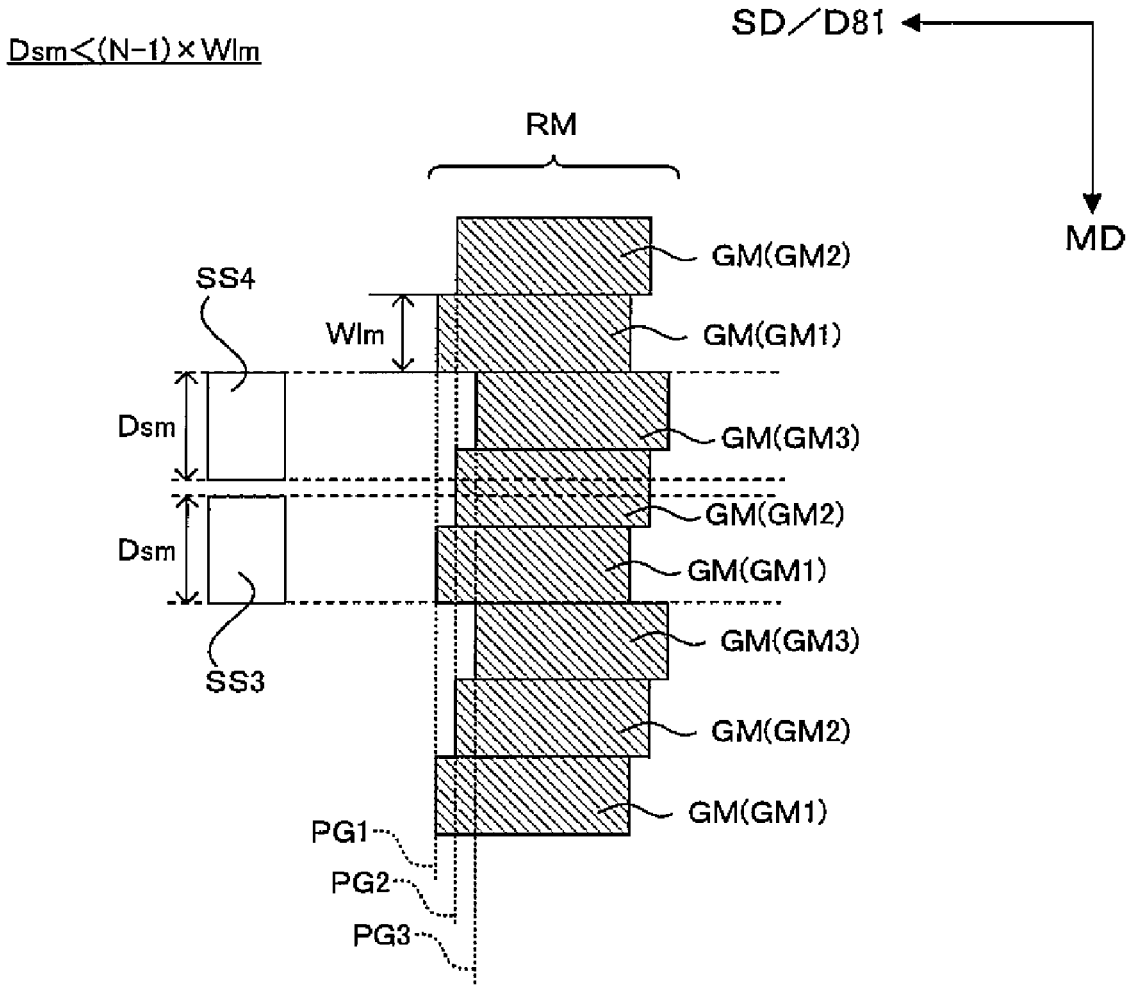
FIG. 26 is a diagram showing a case where the main-scanning spot diameter is narrower than (N−1)-fold of the unit width.

FIG. 26 is a diagram showing a case where the main-scanning spot diameter is narrower than (N−1)-fold of the unit width. In this case, the detection result of the optical sensor SC may possibly differ depending on the position of the sensor spot relative to the registration mark RM. For example, in the case of detecting the registration mark RM by a sensor spot SS3 of FIG. 26, the group toner image GM1 first reaches the sensor spot SS3. On the other hand, in the case of detecting the registration mark RM by a sensor spot SS4 of FIG. 26, the group toner image GM2 downstream of the group toner image GM1 in the conveying direction D81 first reaches the sensor spot SS4. Accordingly, rising timings of the detection signals differ in the sensor spots SS3, SS4.

On the contrary, the main-scanning spot diameter Dsm of the sensor spot SS shown in FIG. 25 is wider than (N−1)-fold of the unit width Wlm. In other words, the main-scanning spot diameter Dsm of the sensor spot SS is wider than the twofold of the unit width Wlm. Accordingly, even if the position of the sensor spot SS is displaced relative to the registration mark RM, the group toner image GM1 first reaches the sensor spot SS, wherefore the rising timing of the detection signal can be stable regardless of the position of the sensor spot SS. Thus, the optical sensor SC having the sensor spot SS shown in FIG.

25 is preferable since being able to output more stable detection signals than the optical sensors SC having the sensor spots shown in FIG. 26.

VI-3. Third Embodiment

Figure 27:
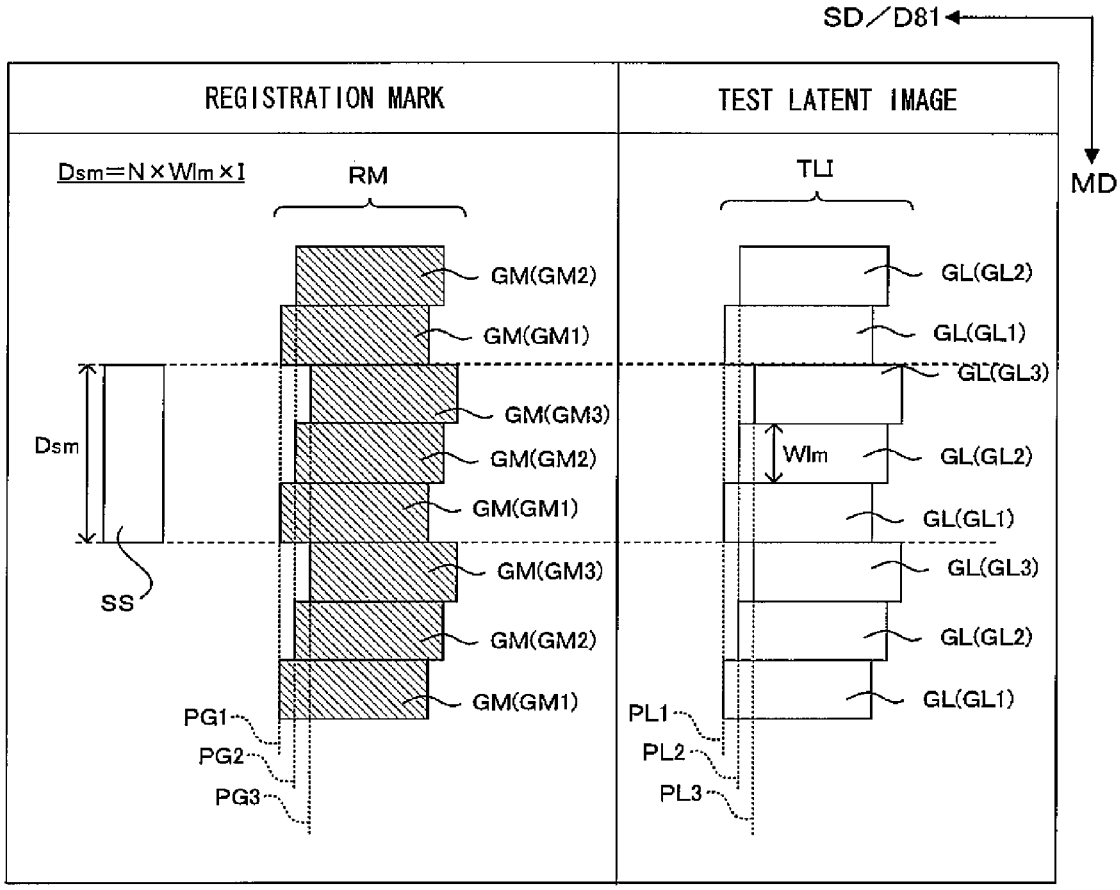
FIG. 27 is a diagram showing a relationship of a sensor spot of an optical sensor according to a third embodiment with a test image and a registration mark.

FIG. 27 is a diagram showing a relationship of a sensor spot of an optical sensor according to a third embodiment with a test image and a registration mark. In the third embodiment, the widths of a test latent image TLI and a registration mark RM in the main scanning direction MD are wider than the sum of the widths (=Whm+Wlm+Wlm) of images (group toner images GM1, GM2, GM3) respectively formed by N lenses LS, which are adjacent in the main scanning direction MD and capable of exposure, in the main scanning direction MD. A sensor spot S has a width equal to this sum of the widths (=Whm+Wlm+Wlm) in the main scanning direction MD. In other words, as described next, the widths of the sensor spot, the test latent image and the registration mark can be said to be set according to a width determined by an integer multiple of the unit width Wlm. The configurations of such sensor spot, test latent image and registration mark will be described below through the description of the color misregistration correction operation. As described above, in the color misregistration correction operation, the test latent image TLI is first formed. In the third embodiment, this test latent image TLI is formed by (N×I) or more group latent images GL adjacent and consecutive in the main scanning direction MD. Further, the respective group latent images GL are formed to have the unit width Wlm in the main scanning direction MD. Accordingly, this test latent image TLI has a width wider than the (N×I)-fold of the unit width Wlm in the main scanning direction. Here, I is an integer. This test latent image TLI is developed to form the registration mark RM, which is detected in the sensor spot SS. A main-scanning spot diameter Dsm of this sensor spot SS is equal to (N×I)-fold of the unit width Wlm. FIG. 27 corresponds to a case where N=3 and I=1, and the main-scanning spot diameter Dsm of the sensor spot SS is equal to the threefold of the unit width Wlm. Accordingly, in the third embodiment, the detection result of the optical sensor can be substantially constant regardless of the displacement of the sensor spot SS. The reason for this will be described next.

Figure 28:
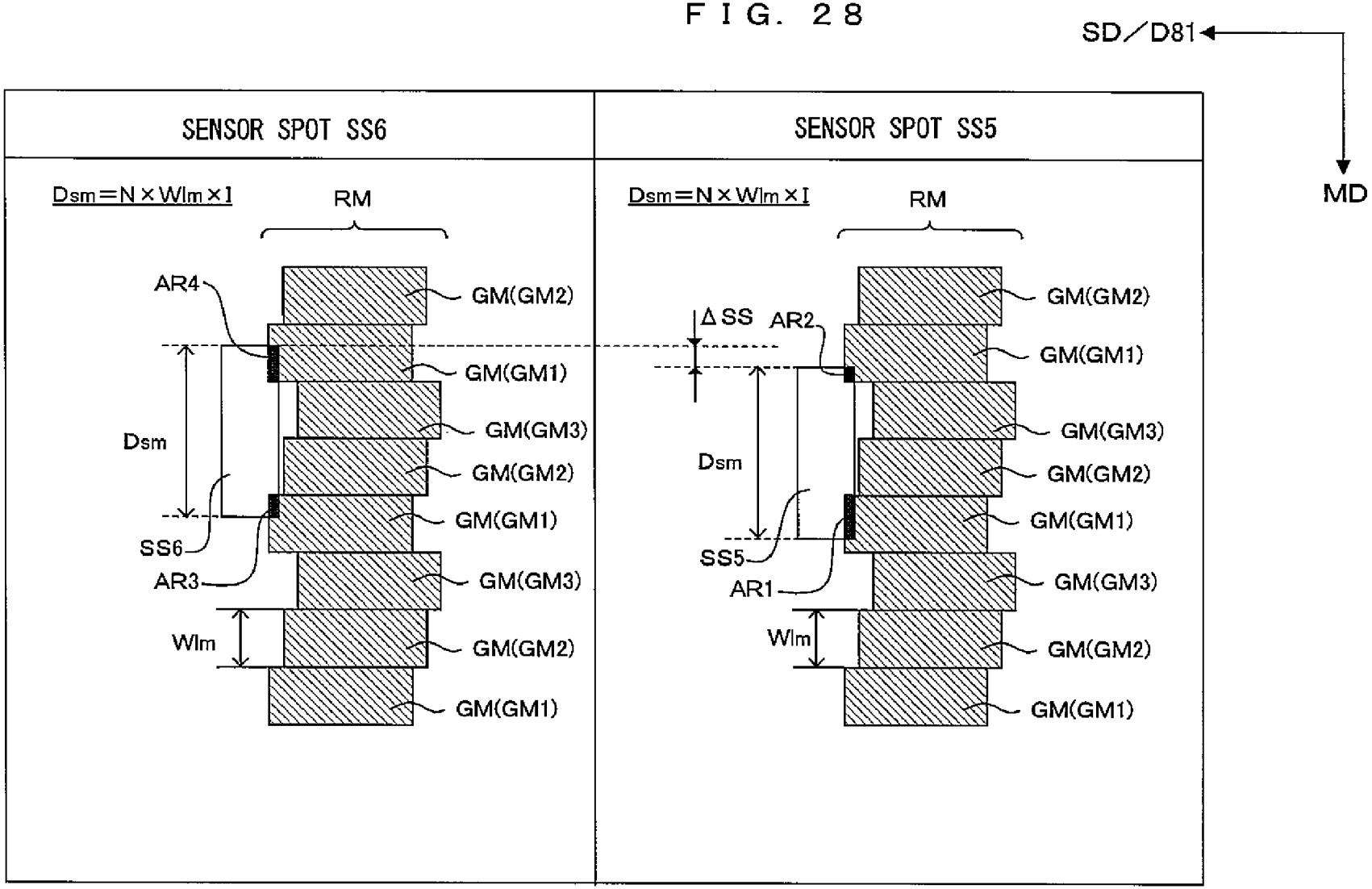
FIG. 28 is a diagram showing a relationship between a displacement of the sensor spot in the main scanning direction and the detection result of the optical sensor.

FIG. 28 is a diagram showing a relationship between a displacement of the sensor spot in the main scanning direction and the detection result of the optical sensor. Columns "SENSOR SPOT SS5" and "SENSOR SPOT 886" of FIG. 28 correspond to cases where the registration mark RM reaches the sensor spots SS5, SS6 and detection signals of the optical sensors SC start rising. As shown in FIG. 28, the sensor spots SS5 and SS6 are displaced by a distance ΔSS in the main scanning direction MD. However, both sensor spots SS5, SS6 have the main-scanning spot diameter Dsm equal to the (N×I)-fold of the unit width Wlm (equal to the threefold of the unit width Wlm). Thus, if AR1, AR2 denote regions of the registration mark RM having reached the sensor spot SS5 and AR3, AR4 denote regions of the registration mark RM having reached the sensor spot SS6, the following relationship holds. Specifically, the following equation holds:

(area of region AR1)+(area of region AR2)=(area of region AR3) +(area of region AR4).

Thus, the detection result by the sensor spot SS5 and that by the sensor spot SS6 are substantially equal. Therefore, the third embodiment is preferable since the detection result of the optical sensor SC can be made substantially constant regardless of the position of the sensor spot SS.

VI-4. Fourth Embodiment

In the above embodiments, the invention is applied to the color misregistration correction operation for suppressing the color misregistration in the sub scanning direction SD. However, the application of the invention is not limited to this and the invention may also be applied to a color in is registration correction operation for suppressing the color misregistration in the main scanning direction MD. This will be described below.

Figure 29:
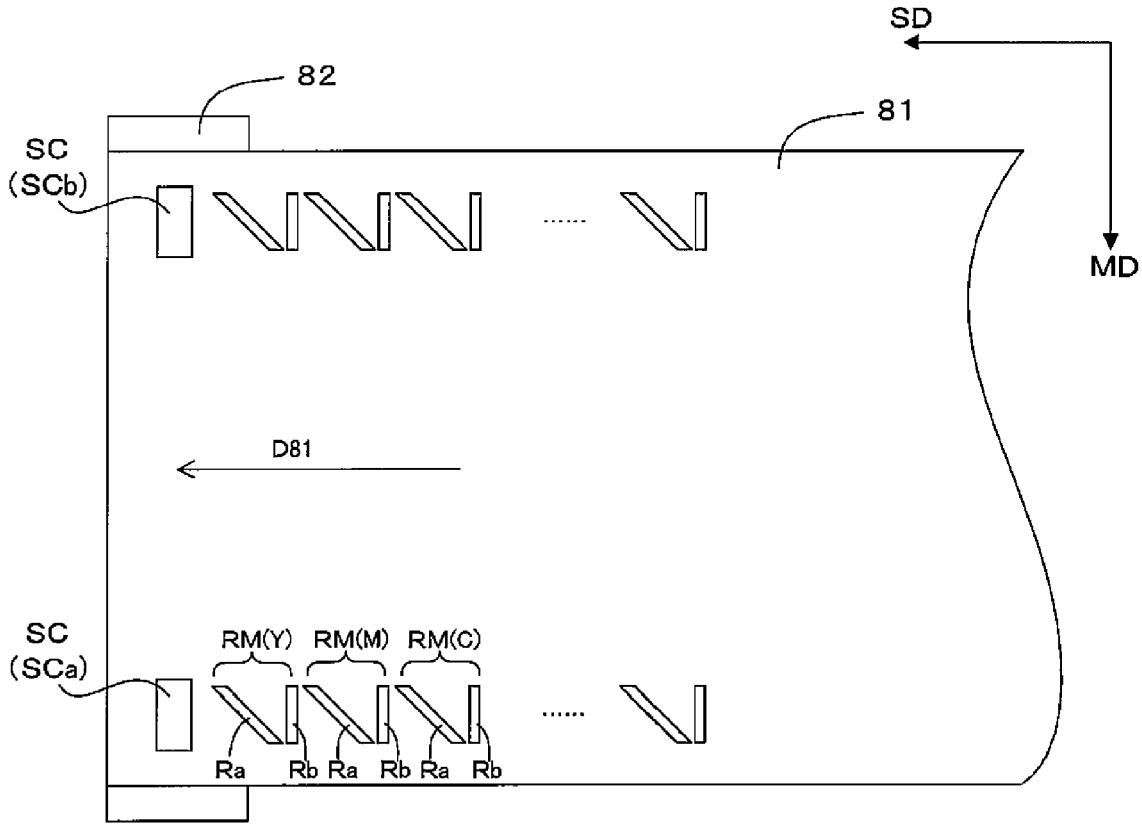
FIG. 29 is a diagram showing registration marks formed in a color misregistration correction operation in the fourth embodiment.

FIG. 29 is a diagram showing registration marks formed in a color misregistration correction operation in the fourth embodiment. The fourth embodiment is similar to the above embodiments in that registration marks RM(Y), RM(M), RM(C) and RM(K) of the respective colors Y, M, C and K are formed side by side in the sub scanning direction SD. However, the configurations of the respective registration marks RM(Y), RM(M), RM(C) and RM(K) differ between the fourth embodiment and the above embodiments. In other words, in the fourth embodiment, each of the registration mark RM(Y), etc. is made up of an oblique part Ra oblique to the main scanning direction MD and a horizontal part Rb substantially parallel to the main scanning direction MD. By detecting the registration marks RM(Y), etc. made up of the oblique parts Ra and the horizontal parts Rb by optical sensors SC, displacements of the registration marks RM(Y), etc. in the main scanning direction MD can be detected.

Figure 30:
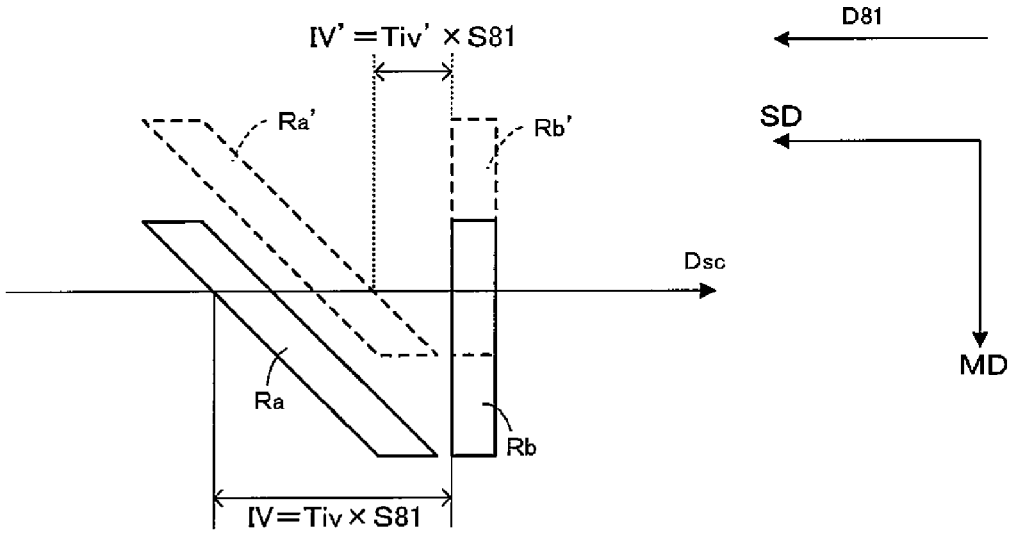
FIG. 30 is a diagram showing the principle of the color misregistration correction operation in the fourth embodiment.

FIG. 30 is a diagram showing the principle of the color misregistration correction operation in the fourth embodiment. The registration mark Ra, Rb shown by solid line in FIG. 30 corresponds the registration mark free from displacement, and the registration mark Ra', Rb' shown by broken line in FIG. 30 corresponds to the registration mark having being displaced.

First of all, a detection operation of the registration mark Ra, Rb free from displacement will be described. Since the transfer belt 81 moves in the moving direction D81 as described above, the registration mark Ra, Rb also moves in the moving direction D81 as this transfer belt 81 moves. Then, the registration mark Ra, Rb passes a sensor spot (not shown in FIG. 30) of the optical sensor SC to be detected by the optical sensor SC. In other words, the sensor spot passes above the registration mark Ra, Rb in a direction of arrow Dsc shown in FIG. 30 to detect the registration mark Ra, Rb. Accordingly, the optical sensor SC detects a downstream edge of the horizontal part Rb in the moving direction D81 after first detecting a downstream edge of the oblique part Ra in the moving direction D81. At this time, an interval between the downstream edge of the oblique part Ra and the downstream edge of the horizontal part Rb on the arrow Dsc is an interval IV. Accordingly, an edge detection time Tiv from the edge detection of the oblique part Ra to that of the horizontal part Rb is obtained from an equation (IV/S81). Here, S81 is a conveying speed of the transfer belt 81.

On the other hand, in an example shown in FIG. 30, the registration mark Ra', Rb' is displaced upward relative to the registration mark Ra, Rb. As a result, an interval IV' between the downstream edge of the oblique part Ra' and the downstream edge of the horizontal part Rb' on the arrow Dsc in the registration mark Ra', Rb' thus displaced is shorter as compared with the case free from displacement (i.e. IV'<IV). Accordingly, an edge detection time Tiv' (=IV'/S81) from the edge detection of the oblique part Ra' to that of the horizontal part Rb' is also shorter than the edge detection time Tiv in the case free from displacement (i.e. Tiv'<Tiv). If the registration mark Ra', Rb' is displaced downward contrary to the example shown in FIG. 30, the edge detection time Tiv' becomes longer than the edge detection time Tiv (i.e. Tiv'>Tiv). As described above, if the registration marks RM(Y), etc. are displaced, the edge detection times Tiv from the downstream edge detections of the oblique parts Ra to those of the horizontal parts Rb vary. Therefore, in the color misregistration correction operation in the fourth embodiment, displacements in the main scanning direction MD among the respective colors are calculated from the edge detection times Tiv.

Figure 31:
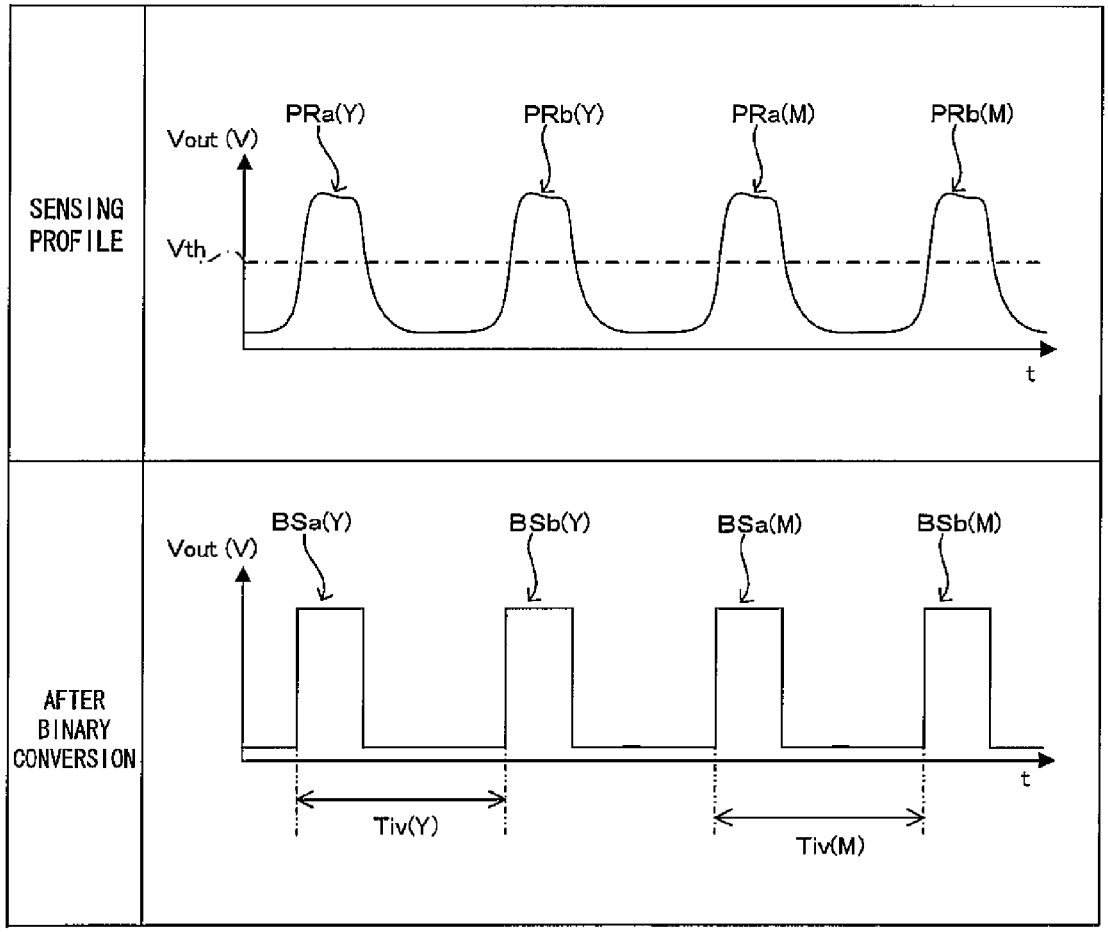
FIG. 31 is graphs showing the color misregistration correction operation in the fourth embodiment.

FIG. 31 is graphs showing the color misregistration correction operation in the fourth embodiment. FIG. 31 shows a case where a displacement in the main scanning direction MD between yellow (Y) and magenta (M) is calculated. In the row "SENSING PROFILE" of FIG. 31 are shown signals outputted from the optical sensor SC upon detecting the registration marks RM(Y), etc. In the row "AFTER BINARY CONVERSION" of FIG. 31 are shown signals obtained by converting the signals shown in the sensing profile into binary values using a threshold voltage Vth. As shown in the sensing profile, the oblique part Ra of the registration mark RM(Y) of yellow (Y) is first detected to obtain a profile signal PRa(Y) and then the horizontal part Rb of the registration mark RM(Y) of yellow (Y) is detected to obtain a profile signal PRb(Y). Subsequently, the oblique part Ra of the registration mark RM(M) of magenta (M) is detected to obtain a profile signal PRa(M) and then the horizontal part Rb of the registration mark RM(M) of magenta (M) is detected to obtain a profile signal PRb(M).

The respective profile signals PRa(Y), PRb(Y), PRa(M and PRb(M) thus obtained are converted into binary values to obtain binary signals BSa(Y), BSb(Y), BSa(M) and BSb(M). The edge detection times Tiv for the respective colors are calculated from rising edge intervals of the binary signals BSa(Y), BSb(Y), BSa(M) and BSb(M). Specifically, the edge detection time Tiv(Y) of yellow (Y) is calculated from the rising edges of the binary signals BSa(Y), BSb(Y), and the edge detection time Tiv(M) of magenta (M) is calculated from the rising edges of the binary signals BSa(M), BSb(M). By multiplying a difference between the edge detection times Tiv of the respective colors (=Tiv(Y)−Tiv(M)) by the moving speed S81 of the transfer belt 81, a displacement in the main scanning direction MD between the registration marks RM(Y) and RM(M) can be calculated.

Positional variations of the group toner images GM may occur also in the registration marks RM shown in FIGS. 29 and 30 due to the speed variation of the photosensitive drum 21 or the like. Accordingly, the registration mark RM and the sensor spot SS may be configured as described next.

Figure 32:
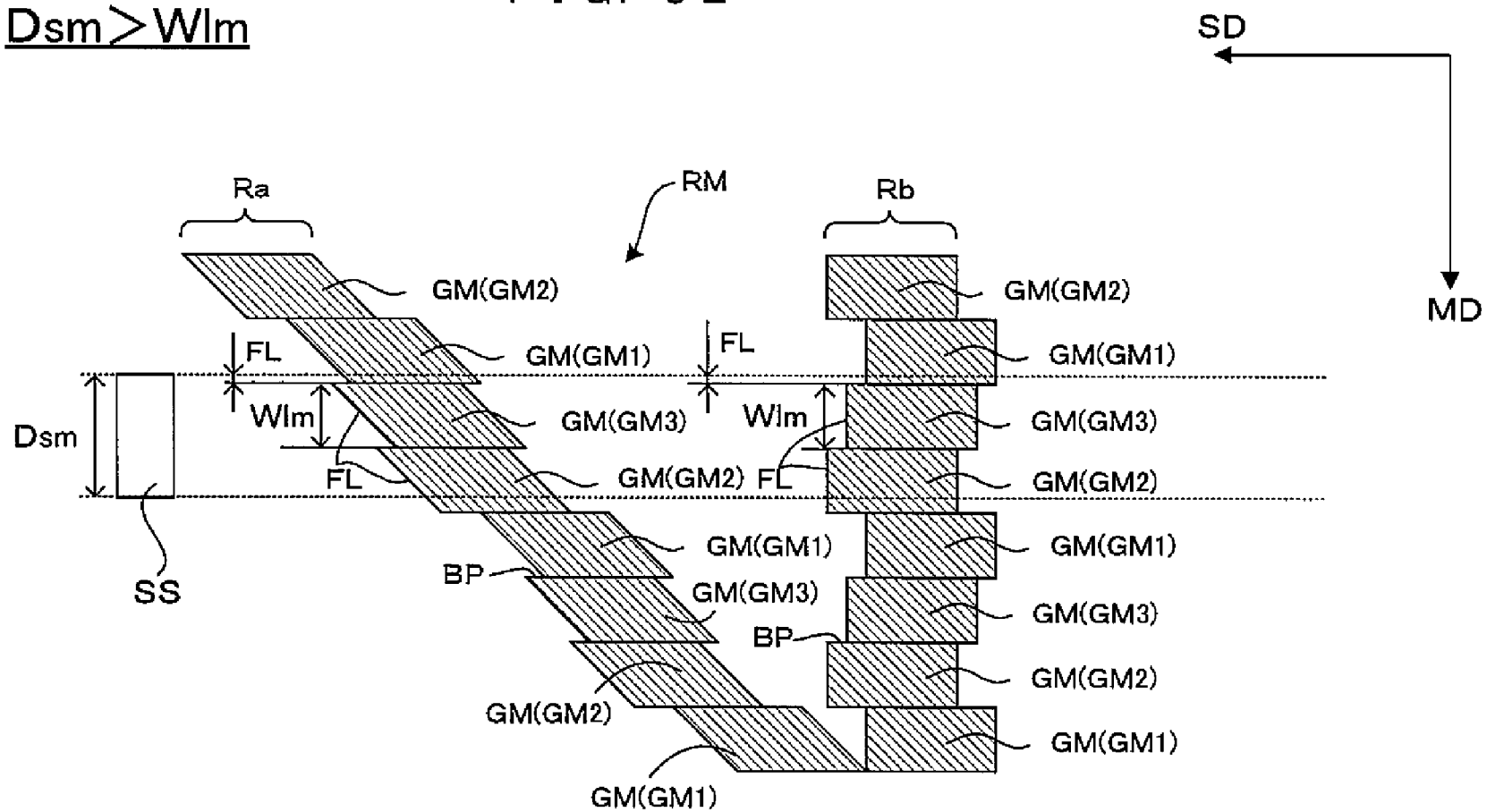
FIG. 32 is a diagram showing the configurations of the registration mark and the sensor spot in the fourth embodiment.

FIG. 32 is a diagram showing the configurations of the registration mark and the sensor spot in the fourth embodiment. As shown in FIG. 32, each of the oblique part Ra and the horizontal part Rb of the registration mark RM is made up of eight group toner images GM (GM1, GM2, GM3) arranged in the main scanning direction MD. In each of the oblique part Ra and the horizontal part Rb, the group toner images GM1, GM2, GM3 are displaced from each other in the sub scanning direction SD, and steps BP are formed at boundary parts between the group toner images GM1, GM2, GM3. The respective group toner images GM1, GM2, GM3 are formed to have the same width as the unit width Wlm in the mains scanning direction MD, and the registration mark RM has a width that is the eightfold of the unit width Wlm in the mains scanning direction MD.

On the other hand, a main-scanning spot diameter Dsm of the sensor spot is formed to have a width wider than the unit width Wlm. Accordingly, in the fourth embodiment as well, the sensor spot SS can detect a flat portion FL free from the steps BP of the registration mark RM (oblique part Ra, horizontal part Rb) over the width wider than the unit width Wlm and reflect it on the detection result on the registration mark RM, whereby the influence of the steps BP on the detection result of the optical sensor SC is suppressed. As a result, the detection result of the optical sensor SC can be made stable.

VI-5. Fifth Embodiment

Figure 33:
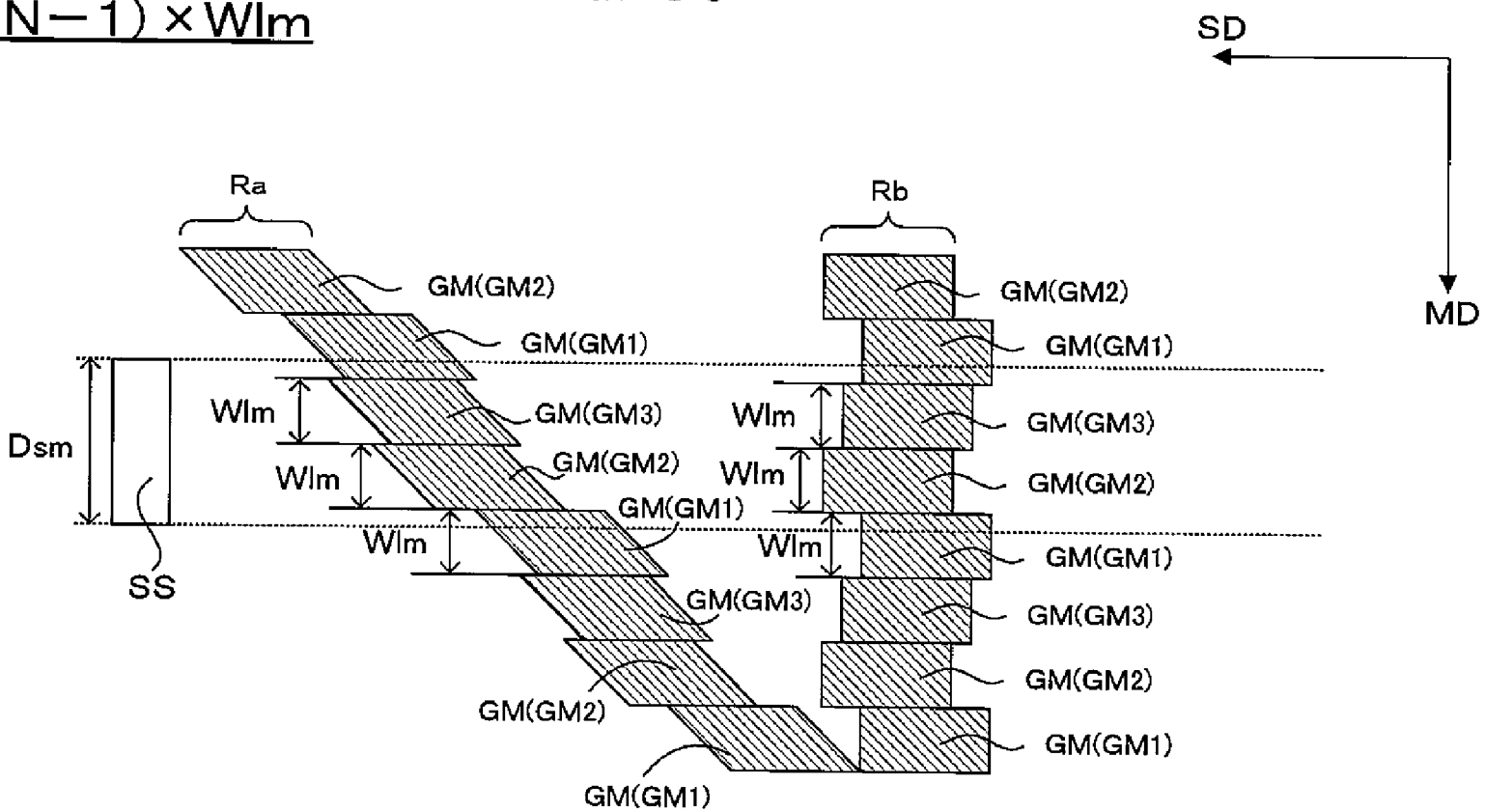
FIG. 33 is a diagram showing a relationship of a sensor spot of an optical sensor according to a fifth embodiment and a registration mark.

FIG. 33 is a diagram showing a relationship of a sensor spot of an optical sensor according to a fifth embodiment and a registration mark. In the fifth embodiment, similar to the second embodiment, the widths of a registration mark RM and a sensor spot SS in the main scanning direction MD are set according to a number J of light emitting element groups 295 constituting a light emitting element group column 295C, i.e. a number J of lenses LS constituting a lens column LSC. Here, J is an integer equal to or greater than 3. In other words, a test latent image TLI, the registration mark RM and the sensor spot SS have the widths in the main scanning direction MD wider than the sum (=Wlm+Wlm) of the widths of images (e.g. group toner images GM1, GM2 or group toner images GM2, GM3, etc.) respectively formed by (J−1) lenses LS, which are adjacent in the main scanning direction MD and capable of exposure, in the main scanning direction MD. In other words, as described next, the widths of the sensor spot, the test latent image and the registration mark are set according to a width determined by an integer multiple of the unit width Wlm. The configurations of such sensor spot and registration mark will be described below through the description of a color misregistration correction operation. As described above, in the color misregistration correction operation, the registration mark RM is formed. In the fifth embodiment, this registration mark RM is formed by N or more group latent images GM adjacent and consecutive in the main scanning direction MD, and the respective group latent images GL are formed to have the unit width Wlm in the main scanning direction MD. Accordingly, the registration mark RM has a width wider than the (N−1)-fold of the unit width Wlm in the main scanning direction. Here, N is an integer equal to or greater than 2 and corresponds to the number of the light emitting element group rows 295R or the number of the light emitting element groups 295 constituting one light emitting element group column 295C (in other words, N corresponds to the number of the lens rows LSR or the number of the lenses LS constituting one lens column LSC). Specifically, in this embodiment, the registration mark RM is wider (eightfold of the unit width Wlm) than the twofold of the unit width Wlm in the main scanning direction MD since there are three light emitting element group rows 295R. This registration mark RM is detected in the sensor spot SS.

As shown in FIG. 33, in the fifth embodiment, a main-scanning spot diameter Dsm of the sensor spot SS is wider than (N−1)-fold of the unit width Wlm. Specifically, the main-scanning spot diameter Dsm of the sensor spot is wider than the twofold of the unit width Wlm. Accordingly, rising timings of detection signals can be made stable regardless of the position of the sensor spot SS as described with reference to FIG. 26 in the second embodiment. Therefore, the detection result of the optical sensor SC can be made stable.

VI-6. Sixth Embodiment

In the above embodiments, displacements among mutually different colors are calculated by detecting the registration marks RM. However, besides displacements among mutually different colors, there are cases where a displacement called "sub scanning magnification displacement" occurs for one color. Specifically, there are cases where the speed of the photosensitive drum 21 is faster or slower than a desired speed, for example, for a certain color to contract or extend an image transferred to the transfer belt 81, with the result that the image transferred to the transfer belt 81 looks as if the magnification thereof would have been deviated in the sub scanning direction SD (as if a sub scanning magnification displacement would have occurred). Such a sub scanning magnification displacement can also be calculated by detecting the registration mark RM as described next.

Figure 34:
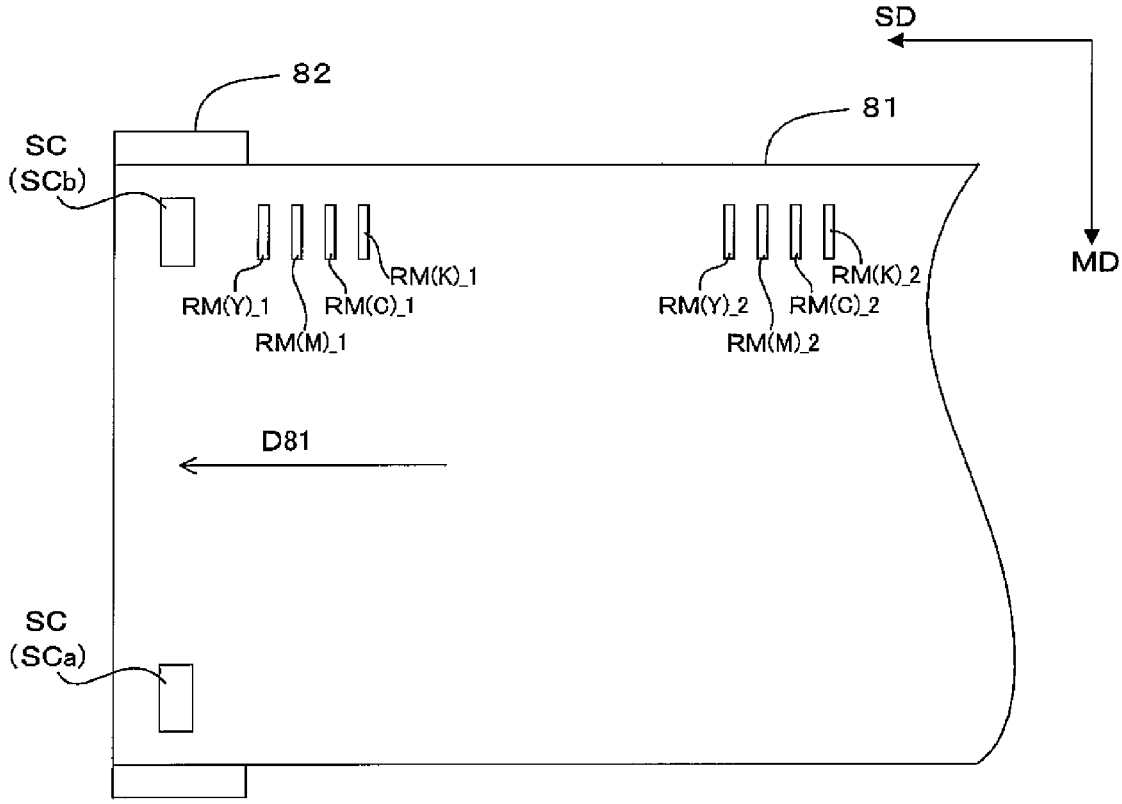
FIG. 34 is a diagram showing registration marks formed in a sub scanning magnification displacement correction operation in the sixth embodiment.

FIG. 34 is a diagram showing registration marks formed in a sub scanning magnification displacement correction operation in the sixth embodiment. As shown in FIG. 34, two registration marks RM are formed for each of the colors Y, M, C and K while being spaced apart in the sub scanning direction SD. For example, for yellow (Y), the registration marks RM(Y)_1, RM(Y)_2 are formed while being spaced apart in the sub scanning direction SD. These two registration marks RM(Y)_1, RM(Y)_2 are detected by an optical sensor SC to calculate a sub scanning magnification displacement for yellow (Y).

Figure 35:
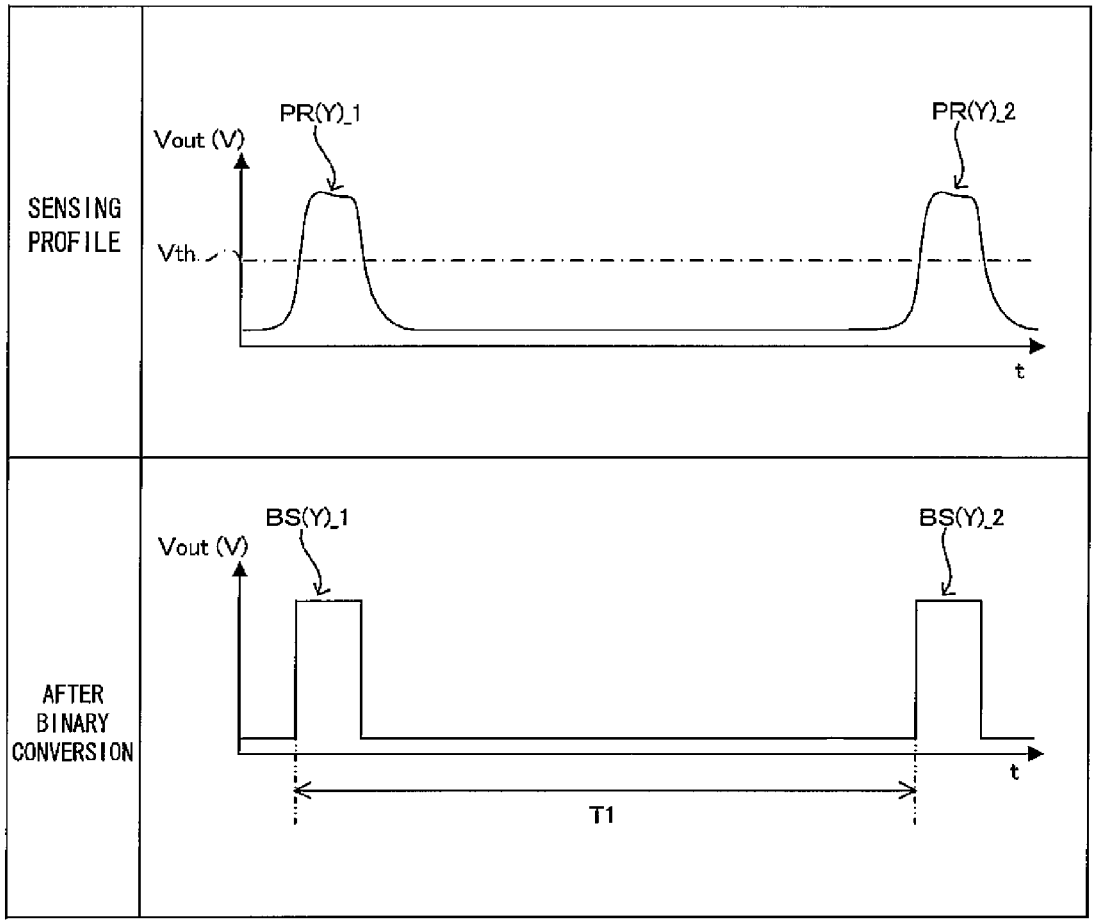
FIG. 35 is graphs showing the sub scanning magnification displacement correction operation in the sixth embodiment.

FIG. 35 is graphs showing the sub scanning magnification displacement correction operation in the sixth embodiment and corresponds to a case of calculating the sub scanning magnification displacement for yellow (Y). In the row "SENSING PROFILE" of FIG. 35 are shown signals outputted by the optical sensor SC upon detecting the registration marks RM(Y)_1, RM(Y)_2. In the row "AFTER BINARY CONVERSION" of FIG. 35 are shown signals obtained by converting the signals shown in the sensing profile into binary values using a threshold voltage Vth. As shown in the sensing profile, the downstream registration mark RM(Y)_1 in the moving direction D81 of the transfer belt 81 is first detected to obtain a profile signal PR(Y)_1 and, then, the upstream registration mark RM(Y)_2 in the moving direction D81 is detected to obtain a profile signal PR(Y)_2.

The respective profile signals PR(Y)_1, PR(Y)_2 thus obtained are converted into binary values to obtain binary signals BSa(Y), BSb(Y). An edge detection time T1 is calculated from a rising edge interval of the binary signals BSa(Y), BSb(Y), and an interval between the registration marks PR(Y)_1, PR(Y)_2 in the sub scanning direction SD is calculated by multiplying this edge detection time T1 by the conveying speed S81 of the transfer belt 81. Then, by calculating how far the thus calculated interval between the registration marks PR(Y)_1, PR(Y)_2 is deviated from a desired value, the sub scanning magnification displacement can be calculated for yellow (Y). Sub scanning magnification displacements can be similarly calculated for the colors other than yellow (Y). By controlling, for example, the emission timings of the light emitting elements 2951 based on the thus calculated sub scanning magnification displacements, the length of the image to be transferred to the transfer belt 81 in the sub scanning direction SD can be set to a suitable length.

There are cases where the positional variation of the group toner images GM occurs even in the registration mark RM shown in FIG. 34 due to the speed variation of the photosensitive drum 21 or the like. Accordingly, even in the case of detecting the registration mark RM to calculate the sub scanning magnification displacement, the configurations of the registration mark RM and the sensor spot SS as in the first to fifth embodiments are preferable since they can make the detection result of the optical sensor SC stable regardless of the variation of the group toner images GM.

VI-7. Seventh Embodiment

Figure 36:
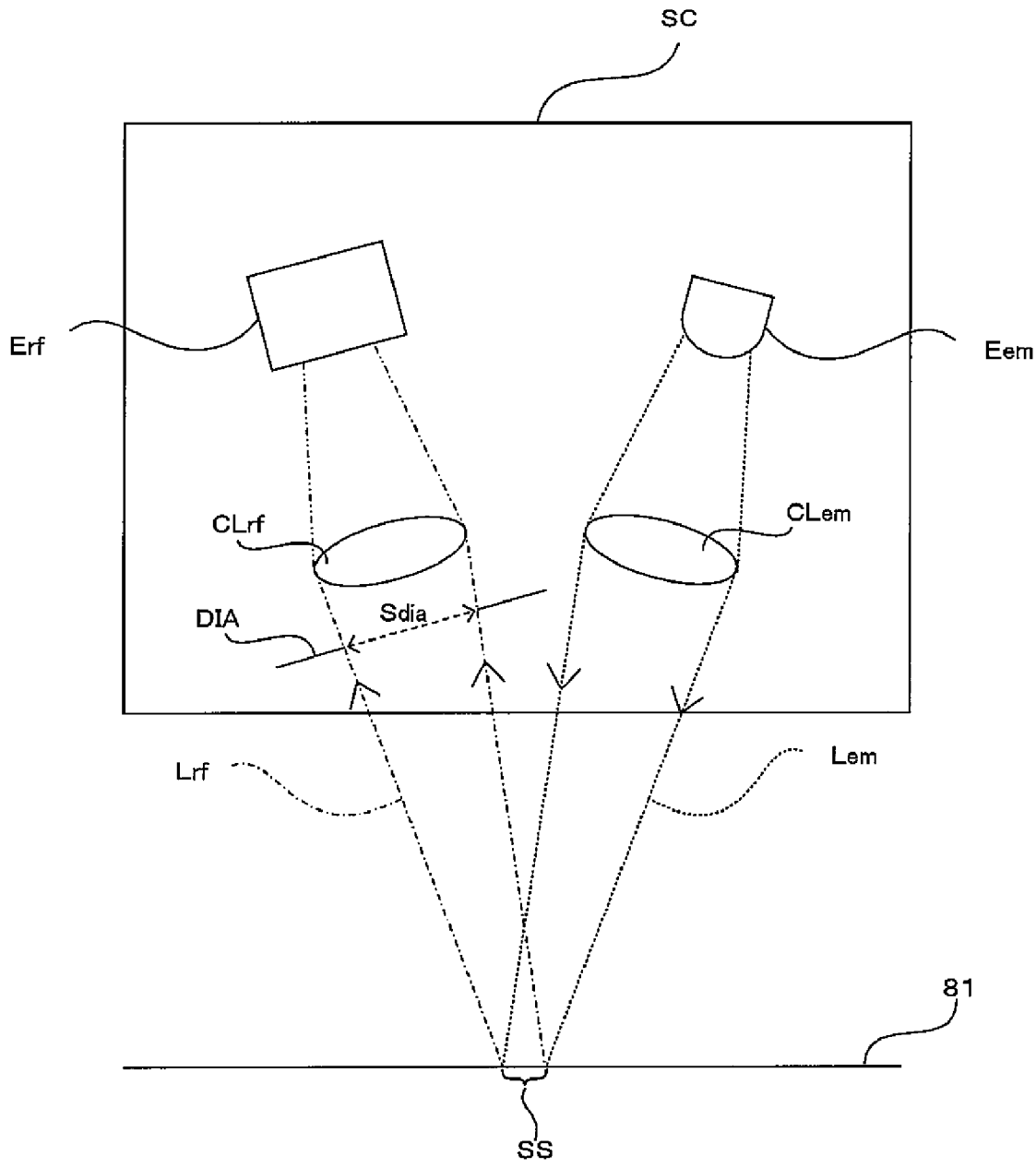
FIG. 36 is a diagram showing an optical sensor in the seventh embodiment.

FIG. 36 is a diagram showing an optical sensor in the seventh embodiment. The optical sensor SC according to the seventh embodiment is similar to the optical sensor SC shown in FIG. 17 except in including an aperture diaphragm DIA. This aperture diaphragm DIA is provided between the sensor spot SS and the light emitter Erf. Accordingly, only light having passed through the aperture diaphragm DIA out of light reflected by the transfer belt 81 can reach the light emitter Erf. Further, an area Sdia of the opening of the aperture diaphragm DIA is variable, and the quantity of the light reaching the light emitter Erf can be controlled by adjusting the opening area Sida. In other words, in this optical sensor, the size and shape of the sensor spot SS can be adjusted by changing the opening area Sdia. Such a function of adjusting the sensor spot SS can also be realized by providing the aperture diaphragm DIA between the light emitter Fem and the sensor spot SS. In other words, in this case, only light having passed through the aperture diaphragm DIA out of light emitted from the light emitter Eem can be reflected by the transfer belt 81 and reach the light emitter Erf. Accordingly, the quantity of the light reaching the light receiver Erf can be controlled and the size and shape of the sensor spot SS can be adjusted by changing the opening area Sdia.

As described above, in the seventh embodiment, the aperture diaphragm DIA is provided and the light quantity used for the detection of a detection image can be restricted by the aperture diaphragm. As a result, the occurrence of a problem that the detection result is disturbed, for example, by stray lights can be suppressed. Since the aperture diaphragm is formed such that the light quantity passing through this aperture diaphragm is variable, the light quantity used for the detection of a detection image can be adjusted if necessary. In other words, the size and shape of the sensor spot SS can be adjusted. Therefore, the diameter of the sensor spot SS can be easily set as in the above embodiments and the detection result of the optical sensor SC can be made stable.

VI-8. Miscellaneous

As described above, in the above embodiments, the main scanning direction MD corresponds to a "first direction" of the invention; the sub scanning direction SD to a "second direction" of the invention; and the head substrate 293 to a "substrate" of the invention. Further, in the above embodiments, the respective image forming stations Y, M, C and K correspond to "image forming sections" of the invention; the photosensitive drum 21 to a "latent image carrier" of the invention; the light emitting element group column 295C to a "group column"; the optical sensor SC to a "detector" of the invention; and the sensor spot SS to a "detection area" of the invention. Further, the lens LS corresponds to an "imaging optical system" of the invention; the lens column LSC to a "imaging optical system column " of the invention; the light emitting element group 295 to "a plurality of light emitting elements" of the invention; the unit width Wlm to a "width of an image formed by one imaging optical system" of the invention; and the registration mark RM to a "detection image" of the invention. Furthermore, the line head 29 corresponds to an "exposure head" of the invention.

An embodiment of an image forming apparatus according to the invention comprises an image forming section and a detector. The image forming section includes a latent image carrier whose surface moves in a second direction orthogonal to or substantially orthogonal to a first direction and is adapted to form a test latent image by exposing the surface of the latent image carrier by means of a line head and to form a test image by developing the test latent image. The detector detects the test image passing a detection area in the direction orthogonal to or substantially orthogonal to the first direction. The line head includes a substrate having a plurality of light emitting elements grouped into light emitting element groups. The respective light emitting element groups emit light beams toward the surface of the latent image carrier and can expose regions mutually different in the first direction. The test latent image is made up of a plurality of latent images formed by the mutually different light emitting element groups and adjacent in the first direction. The test latent image and the detection area are wider in the first direction than the width of the latent images formed by all the light emitting elements belonging to one light emitting element group.

Further, an embodiment of an image forming method according to the invention comprises a test image forming step and a detecting step. The test image forming step is a step of forming a test latent image by exposing a surface of a latent image carrier moving in a second direction orthogonal to or substantially orthogonal to a first direction by means of a line head and of forming a test image by developing the test latent image. The detecting step is a step of detecting the test image passing a detection area in the direction orthogonal to or substantially orthogonal to the first direction. The line head includes a substrate having a plurality of light emitting elements grouped into light emitting element groups. The respective light emitting element groups emit light beams toward the surface of the latent image carrier and can expose regions mutually different in the first direction. The test latent image is made up of a plurality of latent images formed by the mutually different light emitting element groups and adjacent in the first direction. The test latent image and the detection area are wider in the first direction than the width of the latent images formed by all the light emitting elements belonging to one light emitting element group.

In the embodiments (image forming apparatus, image forming method) thus constructed, the test latent image and the detection area are wider in the first direction than the width of the latent images formed by all the light emitting elements belonging to one light emitting element group. Accordingly, the detection result on the test image can be stably obtained regardless of the variation of the above test image.

A plurality of latent images constituting the test latent image may be formed to overlap with an overlapping width wider than the detection area in the second direction. Such a construction is preferable since the detection result on the test image can be made more stable.

The line head may be disposed such that the longitudinal direction thereof corresponds to the first direction and the width direction thereof corresponds to the second direction, group columns, in each of which N (N is an integer equal to or greater than 2) light emitting element groups capable of exposure are arranged in the first direction while being displaced from each other in the width direction, may be arranged in the longitudinal direction on the substrate, and the test latent image and the detection area may be formed wider than the (N−1)-fold of the width of the latent images formed by all the light emitting elements belonging to one light emitting element group. In such a construction, the width of the detection area is wider than the (N−1)-fold of the width of the latent images formed by all the light emitting elements belonging to one light emitting element group. Accordingly, the detection result on the test image can be made more stable.

The apparatus in which the above group columns are arranged may be constructed as follows. Specifically, in the first direction, the test latent image is wider than the (N−I-fold (I is an integer) of the width of the latent images formed by all the light emitting elements belonging to one light emitting element group and the width of the detection area in the first direction is the (N−I)-fold of the width of the latent images formed by all the light emitting elements belonging to one light emitting element group. Such a construction is preferable since the detection result on the test image can be made more stable.

The width of the detection area in the first direction may be longer than the length of the detection area in the second direction. With such a construction, the detection result on the test image can be made more stable.

Both ends of the detection area in the second embodiment may be straight parallel to the first direction. Such a construction is preferable since the detection result on the test image can be made more stable.

The invention is not limited to the above embodiments and various changes other than the above can be made without departing from the gist thereof. For example, the test latent image TLI is made up of eight group latent images GL in the first embodiment, but it is not essential to the invention to constitute the test latent image TLI as above. In short, it is sufficient that the test latent image TLI is wider than the latent images formed by all the light emitting elements 2951 belonging to one light emitting element group 295 in the main scanning direction MD. In other words, it is sufficient that the test latent image TLI is wider than the unit width Wlm in the main scanning direction MD. By developing this test latent image TLI, a detection image having a width wider than the unit width Wlm in the main scanning direction MD can be obtained.

In the first embodiment, the respective group latent images GL constituting the test latent image TLI are formed by all the light emitting elements 2951 belonging to one light emitting element group 295. As a result, all the group latent images GL constituting the test latent image TLI have the unit width Whm in the main scanning direction MD. However, it is not essential to the invention to form the test latent image TLI as above. In short, it is sufficient that the test latent image TLI is wider than the unit width Wlm in the main scanning direction MD. Accordingly, it is also possible to configure the test latent image TLI as follows.

Figure 37:
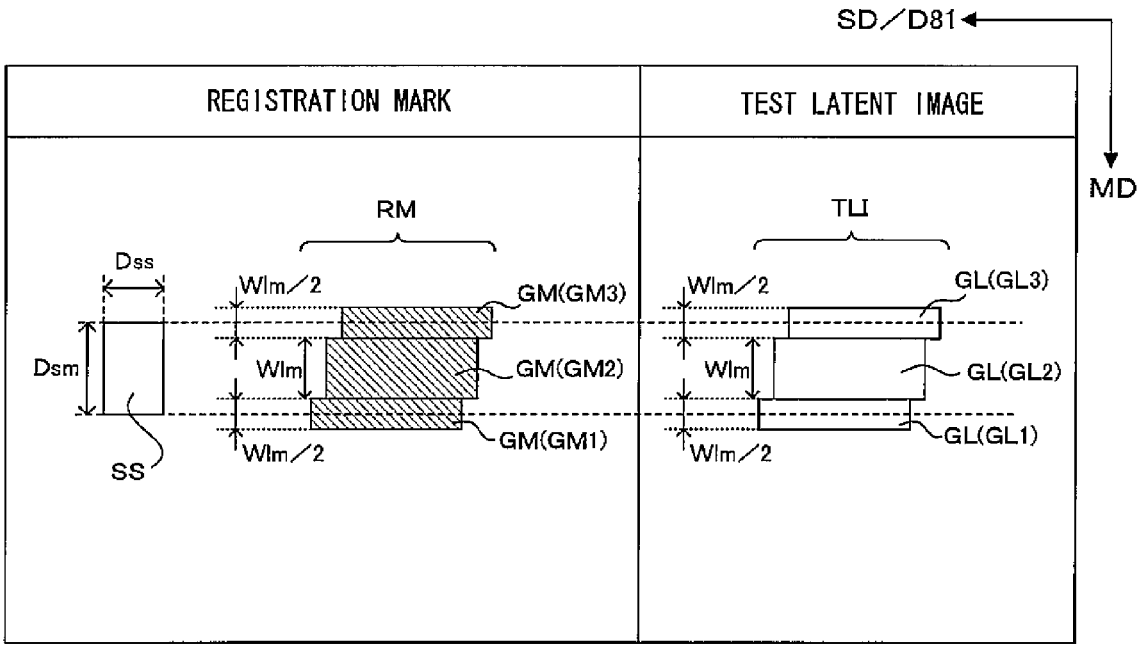
FIG. 37 is a diagram showing another configuration of the test latent image.

FIG, 37 is a diagram showing another configuration of the test latent image. As shown in FIG. 37, the test latent image TLI is made up of three group latent images GL and has a width equal to the twofold of the unit width Wlm in the main scanning direction MD. What should be noted here is that the group latent image GL at each of the opposite ends in the main scanning direction are respectively formed by half of the light emitting element 2951 belonging to one light emitting element group 295 and has a width equal to half the unit width Wlm in the main scanning direction MD. By such a configuration as well, the test latent image TLI wider than the unit width Wlm in the main scanning direction MD can be formed. By developing this test latent image TLI, a detection image having a width wider than the unit width Wlm in the main scanning direction MD can be obtained.

Further, in the above embodiment, the light emitting element group 295 includes a plurality of light emitting element rows 2951R. Accordingly, the respective group latent images GL constituting the test latent image TLI may be formed, for example, by causing only one of the plurality of light emitting element rows 2951R to emit lights. In other words, the respective group latent images GL may be formed by causing only the light emitting element row 2951I_1 of FIG. 8 to emit lights. A detection image obtained by developing the thus formed test latent image TLI may be detected. In short, it is sufficient that the detection image such as a registration mark has a width wider than the unit width Wlm in the main scanning direction MD.

In the second and third embodiments as well, all the group latent images GL constituting the test latent image TLI have the unit width Wlm in the main scanning direction MD. However, it is not essential that all the group latent images GL have the unit width Wlm in the main scanning direction MD.

In the above embodiments, the sensor spot SS has the sub-scanning spot diameter Dss shorter than the overlapping width Wol in the sub scanning direction SD. However, it is also possible to form the sensor spot SS such that the sub-scanning spot diameter Dss thereof is wider than the overlapping width Wol.

Figure 38:
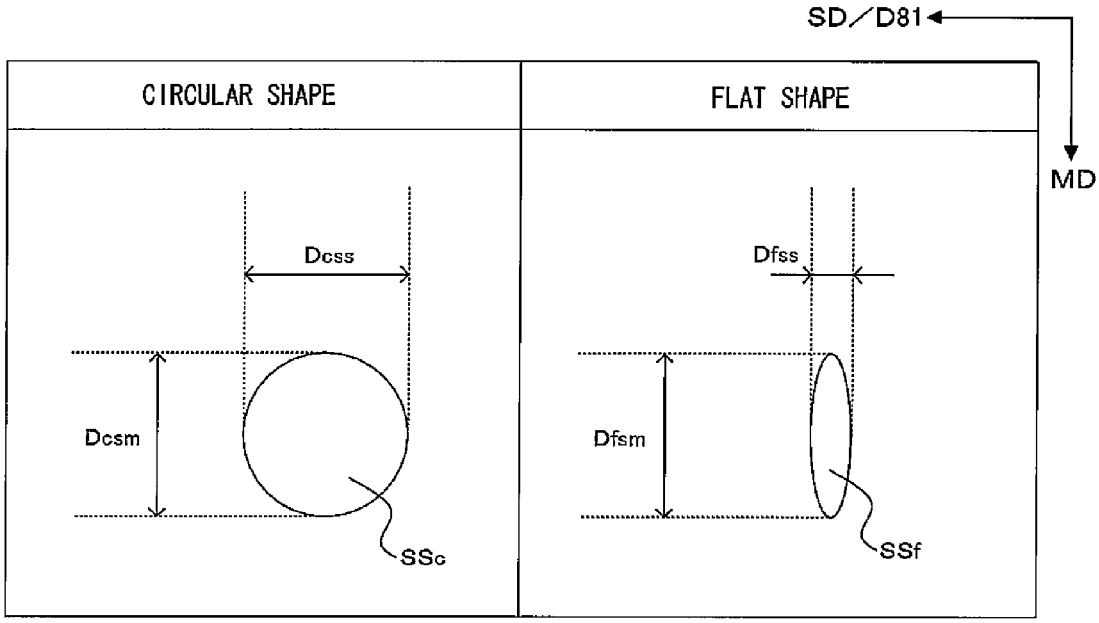
FIG. 38 is a diagram showing a modification of the shape of the sensor spot.

Although the sensor spot SS has a rectangular shape in the above embodiments, the shape thereof is not limited to this and may have a shape as shown in FIG. 38. FIG. 38 is a diagram showing a modification of the shape of the sensor spot. The sensor spot SS may have a circular shape as shown in the column "CIRCULAR SHAPE" of FIG. 38. In a circular sensor spot SSc, a main-scanning spot diameter Dcsm and a sub-scanning spot diameter Dcss can be defined as shown in FIG. 38. Specifically, the width of the circular sensor spot SSc in the main scanning direction MD is the main-scanning spot diameter Dcsm and the width of the circular sensor spot SSc in the sub scanning direction SD is the sub-scanning spot diameter Dcss. Further, the sensor spot SS may have a flat shape as shown in the column "FLAT SHAPE" of FIG. 38. In a flat sensor spot SS, a main-scanning spot diameter Dfsm and a sub-scanning spot diameter Dfss can be defined as shown in FIG. 38. Specifically, the width of the flat sensor spot SSf in the main scanning direction MD is the main-scanning spot diameter Dfsm and the width of the flat sensor spot SSc in the sub scanning direction SD is the sub-scanning spot diameter Dfss.

The above embodiments correspond to the case where one light emitting element group column 295C is made up of three light emitting element groups 295, i.e. the case where "N" of the invention is 3. However, the number of the light emitting element groups 295 constituting one light emitting element group column 295C is not limited to 3 and may be any integer equal to or greater than 2 (i.e. "NN" may be any integer equal to or greater than 2).

Although "I" of the invention is 1 in the third embodiment, the value of "I" is not limited to this and may be 2 or greater.

In the above embodiments, the light emitting element group 295 includes eight light emitting elements 2951. However, the number of the light emitting elements 2951 constituting the light emitting element group 295 is not limited to this and may be 2 or greater.

In the above embodiments, organic EL devices are used as the light emitting elements 2951. However, devices usable as the light emitting elements 2951 are not limited to organic EL devices and LEDs (Light Emitting diodes) may also be used as the light emitting elements 2951.

In the above embodiments, the invention is applied to the so-called tandem image forming apparatus. However, image forming apparatuses to which the invention is applicable are not limited to tandem image forming apparatuses. For example, JP-A-2002-132007 discloses a so-called rotary image forming apparatus including one photosensitive member and one exposure unit and adapted to successively form latent images corresponding to the respective colors on a photosensitive member surface using the exposure unit. The invention is also applicable to such a rotary image forming apparatus.

Figure 39:
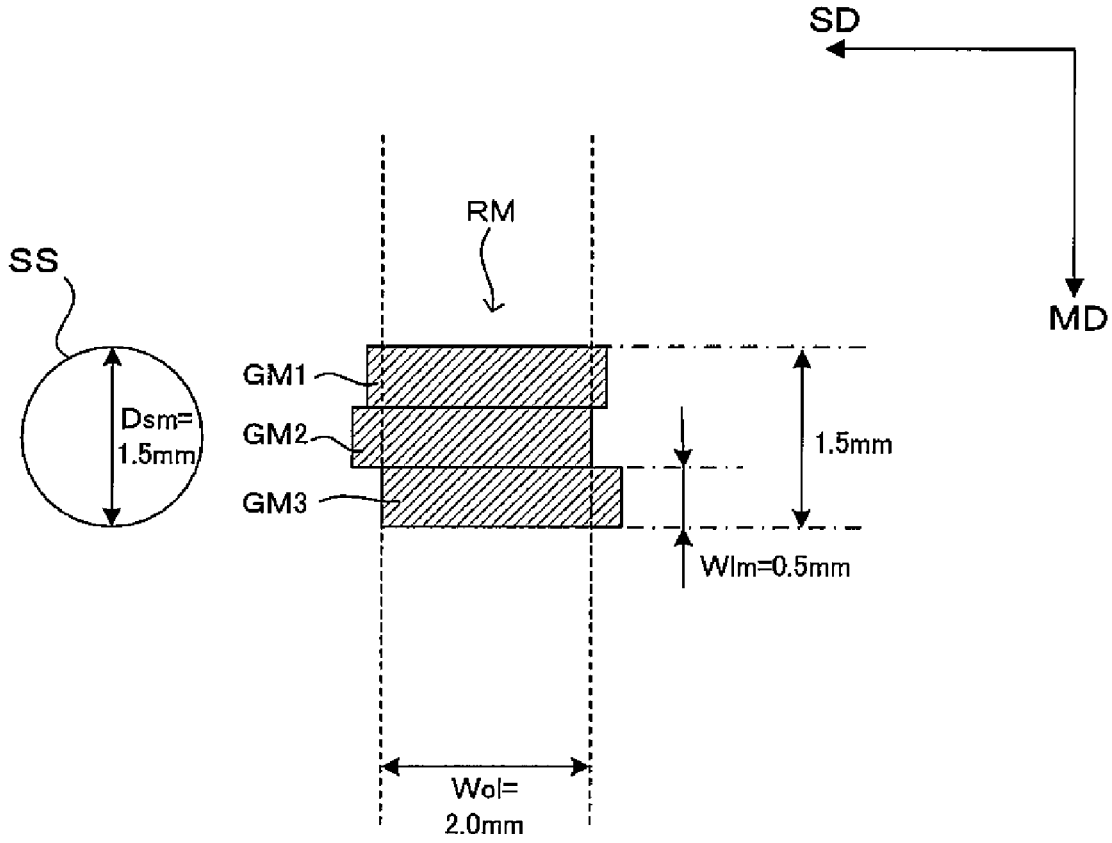
FIG. 39 is a diagram showing exemplary sizes of a sensor spot and a registration mark.

Although specific sizes of the sensor spot SS and the registration mark RM are not particularly described in the above embodiments, these sizes may be set as follows. FIG. 39 is a diagram showing exemplary sizes of a sensor spot and a registration mark. As shown in FIG. 39, the registration mark RM is made up of three group toner images GM1, GM2, GM3 and the respective group toner images GM1, GM2, GM3 are formed to have a unit width Wlm (=0.5 mm) in the main scanning direction NM. Accordingly, the registration mark RM has a width of 1.5 mm in the main scanning direction MD. These group toner images GM1, GM2, GM3 overlap with an overlapping width Wol=2.0 mm in the sub scanning direction SD. On the other hand, the sensor spot SS has a circular shape and a main-scanning spot diameter Dsm thereof is 1.5 mm. Since the sensor spot SS is formed wider than the unit width Wlm in this way, the detection result of an optical sensor SC can be made stable. The sizes of FIG. 39 are merely examples and it goes without saying that the sizes of the sensor spot and the registration mark can be changed if necessary.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an exposure head that includes a plurality of imaging optical systems that are arranged in a first direction and a plurality of light emitting elements that emit lights to be imaged by the imaging optical systems;

a latent image carrier that moves in a second direction orthogonal to or substantially orthogonal to the first direction and carries a latent image formed by the exposure head;

a developer that develops the latent image;

a controller that controls the exposure head and the developer to form a test image so that a width of the test image will have a wider width than that of an image formed by one imaging optical system in the first direction; and a detector that detects the test image.

2. The image forming apparatus according to claim 1, wherein the test image detected by the detector is formed by two or more of the imaging optical systems.

3. The image forming apparatus according to claim 1, wherein the detector has a detection area whose width in the first direction is wider than that of the image formed by one imaging optical system.

4. The image forming apparatus according to claim 3, wherein the detector includes a light emitter that emits a light to the detection area and a light receiver that receives a light reflected from the detection area, and detects the test image based on the light received by the light receiver.

5. The image forming apparatus according to claim 4, comprising an aperture diaphragm that is arranged between the light emitter and the detection area or between the detection area and the light receiver.

6. The image forming apparatus according to claim 3, wherein the exposure head includes an imaging optical system column in which J imaging optical systems are arranged while being displaced in the first and second directions, where J is an integer equal to or greater than 2.

7. The image forming apparatus according to claim 6, wherein the test image detected by the detector and the detection area have widths in the first direction, which are wider than a sum of widths of images formed respectively by (J−1) imaging optical systems that expose areas adjacent in the first direction.

8. The image forming apparatus according to claim 6, wherein the test image detected by the detector has a width in the first direction wider than an I-fold of a sum of widths of images formed by J imaging optical systems adjacent in the first direction, where I is a positive integer, and the detection area has a width in the first direction equal to an I-fold of a sum of widths of images formed by N imaging optical systems adjacent in the first direction, where N is an integer equal to or greater than 2.

9. The image forming apparatus according to claim 1, comprising:

a plurality of image forming sections each including the exposure head, the latent image carrier and the developer; and a transfer unit that includes a transfer medium moving in the second direction and transfers images formed by the plurality of image forming sections to the transfer medium.

10. The image forming apparatus according to claim 9, wherein the plurality of image forming sections form registration marks as the test image, the transfer unit transfers the registration marks to the transfer medium, the detector detects the registration marks transferred to the transfer medium, and the controller obtains positional information on transferred positions of the images formed by the image forming sections and transferred to the transfer medium from a detection result of the detector.

11. The image forming apparatus according to claim 10, wherein the controller controls the transferred positions of the images formed by the image forming sections and transferred to the transfer medium based on the positional information.

12. The image forming apparatus according to claim 1, wherein the latent image carrier is a photosensitive drum that rotates about a central rotation axis thereof.

13. The image forming apparatus according to claim 1, wherein the exposure head includes a light shielding member that is arranged between the plurality of light emitting elements and the plurality of imaging optical systems and is provided with a light guide hole.

14. An image detecting method, comprising:

forming a test image by controlling an exposure head and a developer, the exposure head including a plurality of light emitting elements arranged in the first direction and a plurality of imaging optical systems arranged in the first direction corresponding to the plurality of light emitting elements, the plurality of imaging optical systems imaging lights from the plurality of light emitting elements on the latent image carrier to form a latent image, the developer developing the latent image to form the test image, the test image having a width wider than that of an image formed by one imaging optical system in the first direction; and detecting the test image.

15. An image forming method, comprising:

forming a test image by controlling an exposure head and a developer, the exposure head including a plurality of light emitting elements arranged in the first direction and a plurality of imaging optical systems arranged in the first direction corresponding to the plurality of light emitting elements, the plurality of imaging optical systems imaging lights from the plurality of light emitting elements on the latent image carrier to form a latent image, the developer developing the latent image to form the test image, the test image having a width wider than that of an image formed by one imaging optical system in the first direction; and detecting the test image.

* * * * *